US009976802B2

(12) United States Patent
Han et al.

(10) Patent No.: US 9,976,802 B2
(45) Date of Patent: May 22, 2018

(54) COOLING DEVICE AND METHOD FOR CONTROLLING COOLING DEVICE

(71) Applicant: LG ELECTRONICS INC., Seoul (KR)

(72) Inventors: Junsoo Han, Seoul (KR); Heejun Lee, Seoul (KR); Younseok Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 183 days.

(21) Appl. No.: 14/895,370

(22) PCT Filed: Jun. 3, 2014

(86) PCT No.: PCT/KR2014/004936

§ 371 (c)(1),
(2) Date: Dec. 2, 2015

(87) PCT Pub. No.: WO2014/196787

PCT Pub. Date: Dec. 11, 2014

(65) Prior Publication Data

US 2016/0116208 A1 Apr. 28, 2016

(30) Foreign Application Priority Data

Jun. 3, 2013 (KR) ..... 10-2013-0063207
Jun. 3, 2013 (KR) ..... 10-2013-0063208
(Continued)

(51) Int. Cl.
*F25D 29/00* (2006.01)
*F25D 31/00* (2006.01)
(Continued)

(52) U.S. Cl.
CPC ..... *F25D 31/007* (2013.01); *F25D 11/02* (2013.01); *F25D 25/00* (2013.01); *F25D 29/003* (2013.01);
(Continued)

(58) Field of Classification Search
CPC .. F25D 11/02; F25D 2331/805; F25D 31/007; F25D 2400/28; F25D 2331/803
See application file for complete search history.

(56) References Cited

U.S. PATENT DOCUMENTS 4,358,932 A * 11/1982 Helfrich, Jr. ..... F25D 17/062 62/126
4,977,754 A * 12/1990 Upton ..... A47F 3/0408 221/150 R
(Continued)

FOREIGN PATENT DOCUMENTS

CN 102985772 3/2013
DE 100 46 526 4/2002
(Continued)

OTHER PUBLICATIONS

European Search Report dated Feb. 6, 2017 issued in Application No. 14807940.3.
(Continued)

*Primary Examiner* — Keith Raymond
(74) *Attorney, Agent, or Firm* — KED & Associates, LLP

(57) ABSTRACT

A cooling device according to one embodiment of the present invention comprises: a case; a tray installed inside the case and on which a beverage container is placed; a mixing member configured to perform a seesaw motion about a mixing axis to mix a fluid filled in the beverage container; a driving part connected to the mixing member and configured to provide driving force; and a cool air supply part configured to supply cool air into the case, wherein the mixing member comprises: a supporter configured to protrude from a bottom of the case, the tray being connected to an upper end of the supporter to perform the seesaw motion; a driving link connected to one end of the case; and a mixing motor configured to transmit the driving force to the driving link, wherein the tray comprises: a tray body; a first seating part formed on the tray body so that the beverage container is placed in a lengthwise direction of the
(Continued)

tray body; and a second seating part formed on the tray body in a direction that crosses the first seating part.

19 Claims, 20 Drawing Sheets

(30) Foreign Application Priority Data

Oct. 7, 2013 (KR) ..... 10-2013-0119174
Oct. 7, 2013 (KR) ..... 10-2013-0119175

(51) Int. Cl.
*F25D 11/02* (2006.01)
*F25D 25/00* (2006.01)

(52) U.S. Cl.
CPC .. *F25D 2331/803* (2013.01); *F25D 2331/805* (2013.01); *F25D 2400/28* (2013.01)

(56) References Cited

U.S. PATENT DOCUMENTS 7,703,301 B2 4/2010 Loibl et al.
2008/0202133 A1* 8/2008 Boer ..... F25D 29/00 62/126
2012/0011881 A1* 1/2012 Cho ..... F25D 11/02 62/408
2012/0011883 A1* 1/2012 Cho ..... F25D 17/062 62/408
2012/0011885 A1* 1/2012 Cho ..... F25D 17/065 62/426

FOREIGN PATENT DOCUMENTS

KR 10-0839882 B1 6/2008
KR 20-0275025 Y1 5/2009
KR 10-2012-0009690 A 2/2012
KR 10-2013-0001942 A 1/2013

OTHER PUBLICATIONS

International Search Report dated Sep. 24, 2014 issued in Application No. PCT/KR2014/004936 (with English translation).
Chinese Office Action dated Sep. 18, 2016 issued in Application No. 201480030262.0. (English translation attached).

* cited by examiner

COOLING DEVICE AND METHOD FOR CONTROLLING COOLING DEVICE

CROSS-REFERENCE TO RELATED PATENT APPLICATIONS

This application is a U.S. National Stage Application under 35 U.S.C. § 371 of PCT Application No. PCT/KR2014/004936, filed Jun. 3, 2014, which claims priority to Korean Patent Application Nos. 10-2013-0063207, filed Jun. 3, 2013, and 10-2013-0063208filed Jun. 3, 2013, and 10-2013-0119174 filed Oct. 7, 2013, and 10-2013-0119175 filed Oct. 7, 2013, whose entire disclosures are hereby incorporated by reference.

TECHNICAL FIELD

The present invention relates to a cooling device and a method for controlling the cooling device.

BACKGROUND ART

Generally, a refrigerator is a home appliance which enables food to be stored at a low temperature in an internal storage space covered by a door. To this end, the refrigerator is configured so that an inside of the storage space is cooled using cool air generated by heat exchange with a refrigerant circulated through a refrigeration cycle, and thus the stored food may be stored in an optimum state.

Recent refrigerators have become bigger and have been multifunctionalized according to a change in a dietary life and a trend toward high-quality of a product. Refrigerators having various structures and equipment for convenience in consideration of user convenience are being released.

For example, consumer needs for a cooling device which can rapidly cool beverages or alcoholic drinks having a room temperature in a short time have been increased. To satisfy such consumer needs, various types of cooling devices which enable the beverages or alcoholic drinks to be quickly cooled at one side in a refrigerator have been proposed.

In a refrigerator equipped with a conventional cooling device, a button which is able to select the number of beverage containers accommodated in the cooling device is provided, and a cooling time according to the number of the beverage containers is set by operating the button.

However, in this method, it is inconvenient for a user to directly manually input the number of beverage containers which will be accommodated to cool the drinks, and also an additional manufacturing cost for hardware and software configuring such a mechanism is generated.

Also, in Korean Patent Application No.2010-0115536 which is related to the cooling device and was filed by the applicant of the present invention, a direction of an object to be cooled which is placed at a tray of the cooling device is limited to only one direction. Therefore, to accommodate a plurality of objects to be cooled, e.g., beverage cans, the tray should have a long length, and thus there is a disadvantage that a volume of a case of the cooling device is increased.

As the volume of the case is increased, a capacity of a storage compartment in which the cooling device is installed is reduced. Accordingly, in a small capacity refrigerator in which a storage compartment has a short length in a frontward and backward direction, the cooling device may not be installed.

DISCLOSURE

Technical Problem

The present invention is directed to improving a disadvantage of a manual input operation according to the number of beverage containers to be cooled, when the beverage containers are loaded.

Also, the present invention is directed to providing a method for controlling a cooling device, which is able to reduce an additional manufacturing cost for the manual operation.

Also, the present invention is directed to providing a cooling device which is able to cool a plurality of objects to be cooled, while an entire volume thereof is reduced.

Also, the present invention is directed to providing a cooling device which has a reduced entire volume and thus is able to be installed even at a small capacity refrigerator.

Technical Solution

One aspect of the present invention provides a cooling device including a case; a tray installed inside the case and on which a beverage container is placed; a mixing member configured to perform a seesaw motion about a mixing axis to mix a fluid filled in the beverage container; a driving part connected to the mixing member and configured to provide driving force; and a cool air supply part configured to supply cool air into the case, wherein the mixing member comprises: a supporter configured to protrude from a bottom of the case, the tray being connected to an upper end of the supporter to perform the seesaw motion; a driving link connected to one end of the case; and a mixing motor configured to transmit the driving force to the driving link, wherein the tray comprises: a tray body; a first seating part formed on the tray body so that the beverage container is placed in a lengthwise direction of the tray body; and a second seating part formed on the tray body in a direction that crosses the first seating part.

Another aspect of the present invention provides a method for controlling a cooling device which includes a case; a cover provided at a front surface of the case; a tray installed inside the case and on which a beverage container is seated; a mixing motor configured to provide driving force and to enable the tray to perform a seesaw motion; a driving link configured to transmit the driving force to the tray; a cooling fan configured to supply cool air inside the case; and a control part configured to control driving of the mixing motor and the cooling fan, the method including detecting opening and closing of the cover; driving the mixing motor for a predetermined time, when the closing of the cover is detected, and then stopping the mixing motor, and thus calculating a load applied to the mixing motor; calculating a weight of a beverage according to the load; and calculating a cooling time according to the calculated weight, and driving the cooling fan during the calculated cooling time.

Advantageous Effects

According to the method for controlling the cooling device in accordance with the embodiment of the present invention having the above-described configuration, the mixing motor can automatically detect a weight of the beverage container accommodated in the cooling device, and a cooling time according to the detected weight can be automatically set, and thus the conventional problem of the manual input operation can be improved.

Also, a manufacturing cost for preparing the button for the manual input operation, other control panels and programs can be reduced.

According to the cooling device in accordance with the embodiment of the present invention having the above-described configuration, a length of the cooling device can be reduced, and an amount of objects to be cooled can be maintained.

Also, an entire volume of the cooling device can be reduced, and thus the cooling device can be installed even at a refrigerator having a small capacity, i.e. a short length in a forward and backward direction.

MODES OF THE INVENTION

Hereinafter, a refrigerator according to an embodiment of the present invention will be described in detail with reference to the accompanying drawings.

Figure 1:
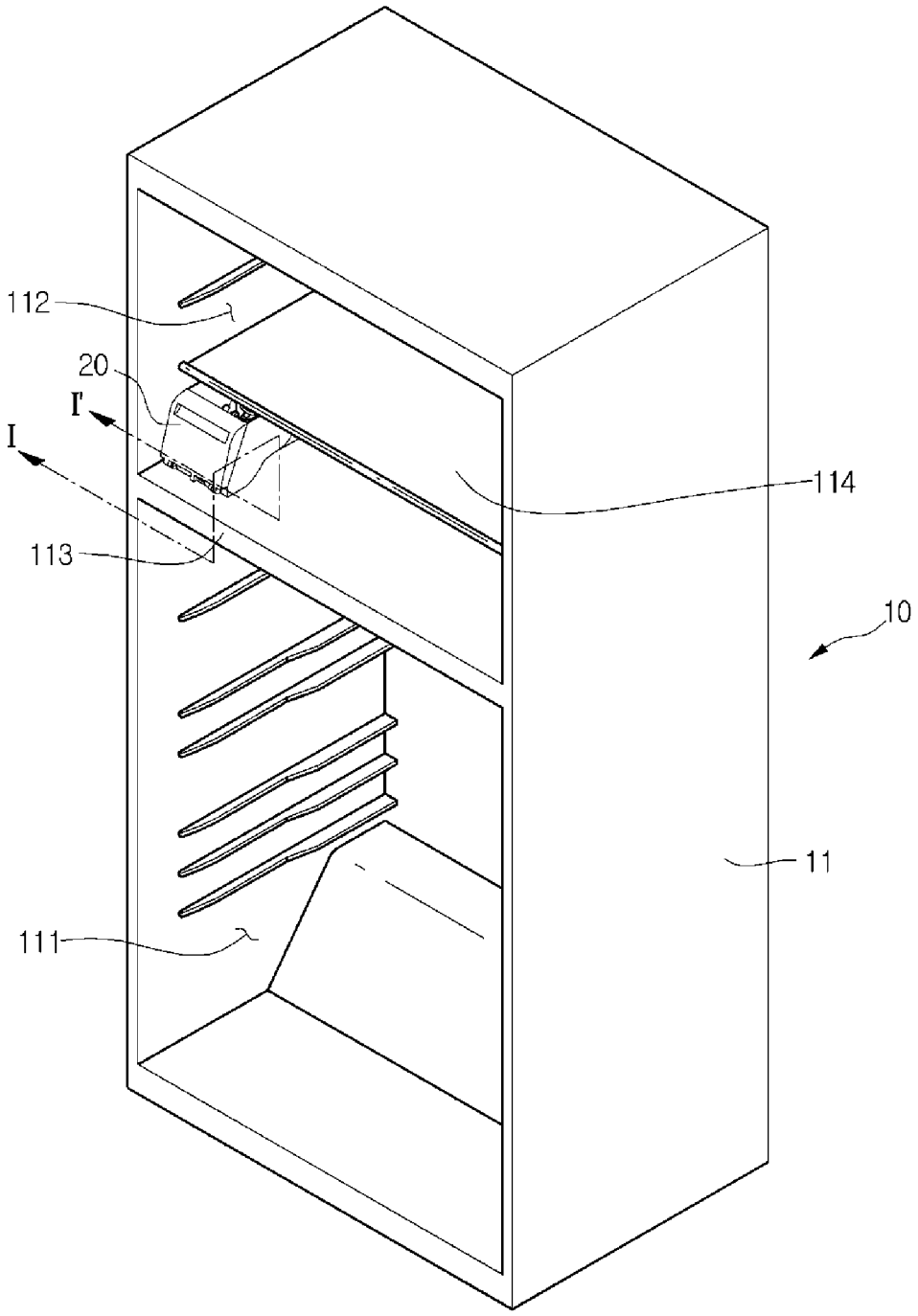
FIG. 1 is a perspective view illustrating an inside of a refrigerator equipped with a cooling device according to a first embodiment of the present invention.

FIG. 1 is a perspective view illustrating an inside of a refrigerator equipped with a cooling device according to a first embodiment of the present invention.

Referring to FIG. 1, a refrigerator 10 equipped with a cooling device according to the first embodiment of the present invention includes a main body 11, and a cooling device 20 which is installed inside the main body 11 to perform a rapid cooling operation.

Specifically, the main body 11 includes a refrigerator compartment 111 and a freezer compartment 112, and the freezer compartment 112 may be disposed above the refrigerator compartment 111. However, the present invention is not limited thereto, and the freezer compartment 112 may be disposed under or beside the refrigerator compartment 111.

The cooling device 20 is a device for rapidly cooling a beverage container such as a beverage can to a lower temperature in a short time. When the cooling device 20 is installed at the freezer compartment, a period of time for cooling a beverage to a set temperature in the freezer compartment may be further reduced.

Also, the cooling device 20 may be installed on a bottom of the freezer compartment 112, or may be located at an edge of one side of the freezer compartment 112. One or more shelves 114 may be disposed above the cooling device 20. The cooling device 20 according to the embodiment of the present invention has a shape of which an upper surface is opened. Therefore, to prevent a foreign substance or food from being introduced through the opened surface, an upper opening portion of the cooling device 20 may be covered by the shelves 114.

Also, the refrigerator compartment 111 and the freezer compartment 112 may be divided by a mullion 113, and a plurality of shelves or drawers may be disposed inside the refrigerator compartment 111.

Hereinafter, a structure and an operation of the cooling device 20 will be described in detail with reference to the drawings.

Figure 2:
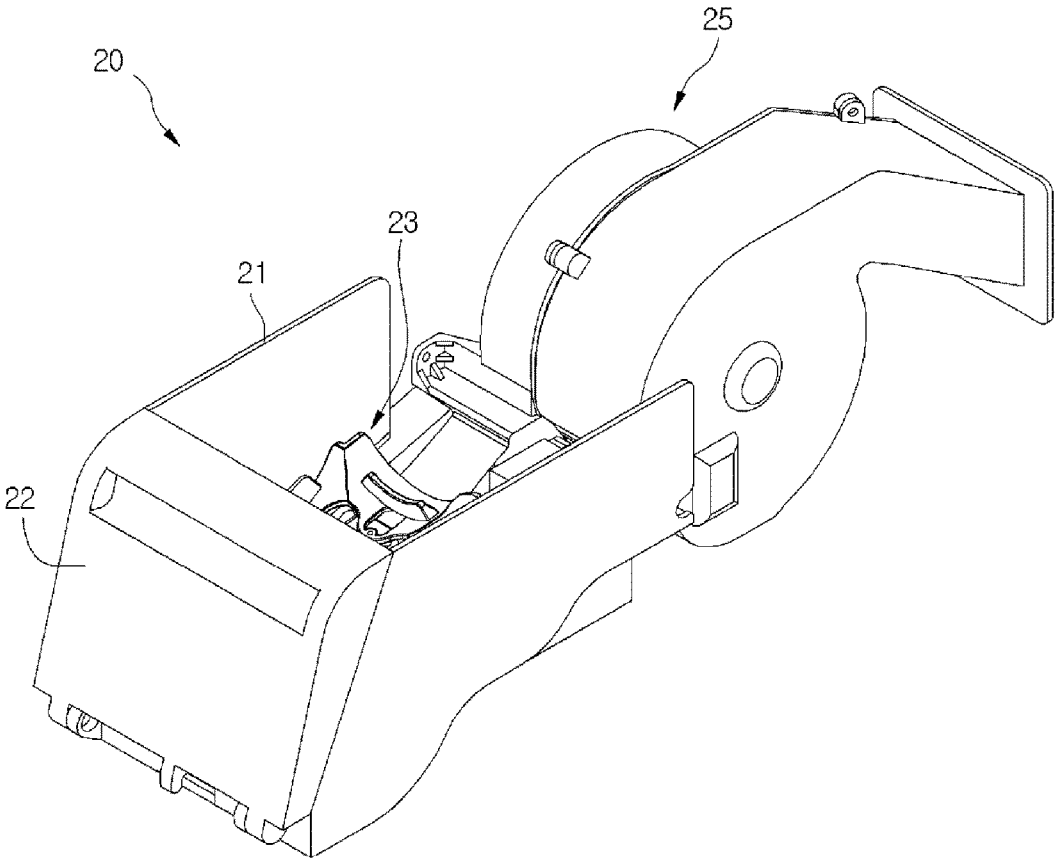
FIG. 2 is a perspective view of the cooling device according to the first embodiment of the present invention.
Figure 3:
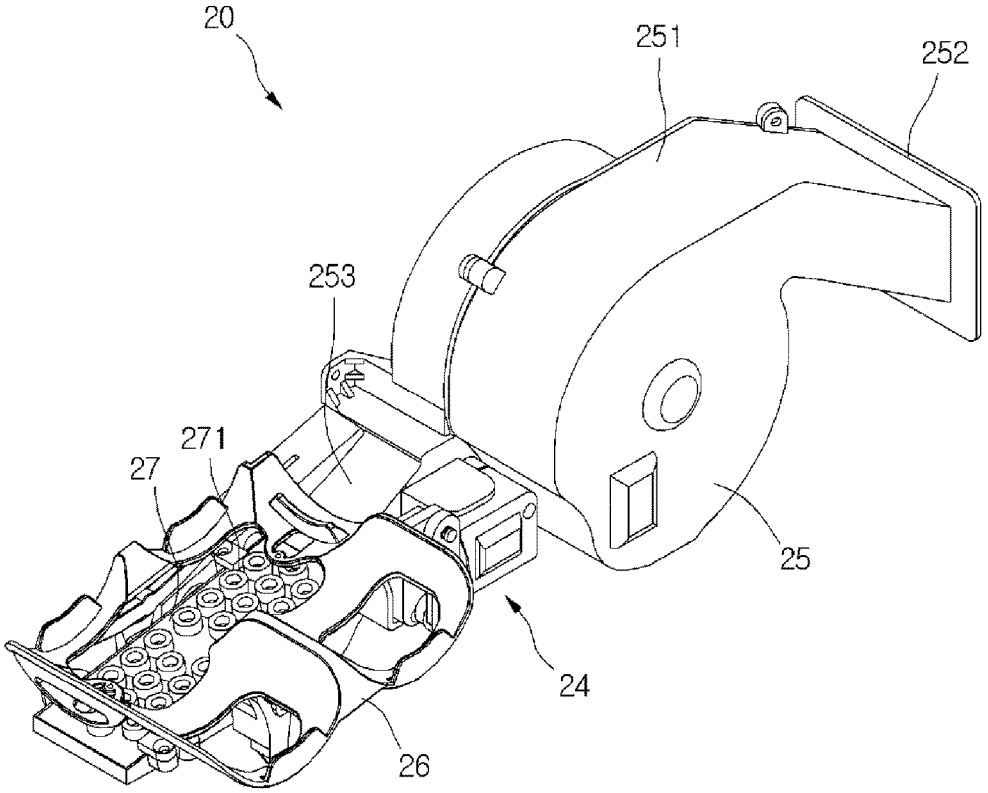
FIG. 3 is a perspective view illustrating the cooling device of which a case is removed.
Figure 4:
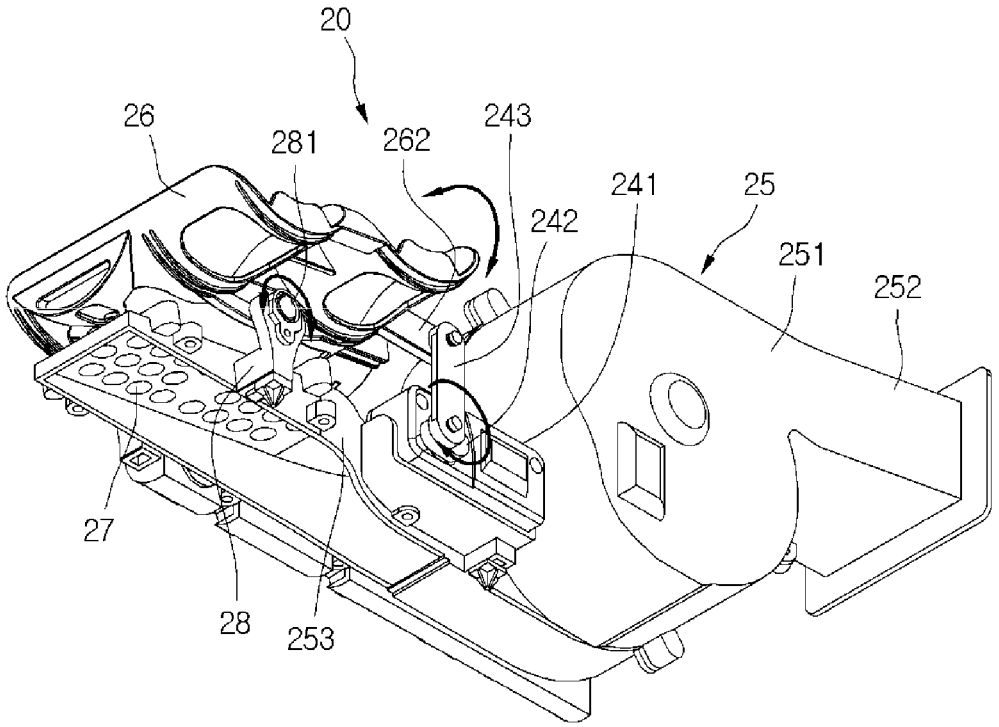
FIGS. 4 and 5 are bottom perspective views illustrating a mixing member of the cooling device according to the first embodiment of the present invention.
Figure 5:
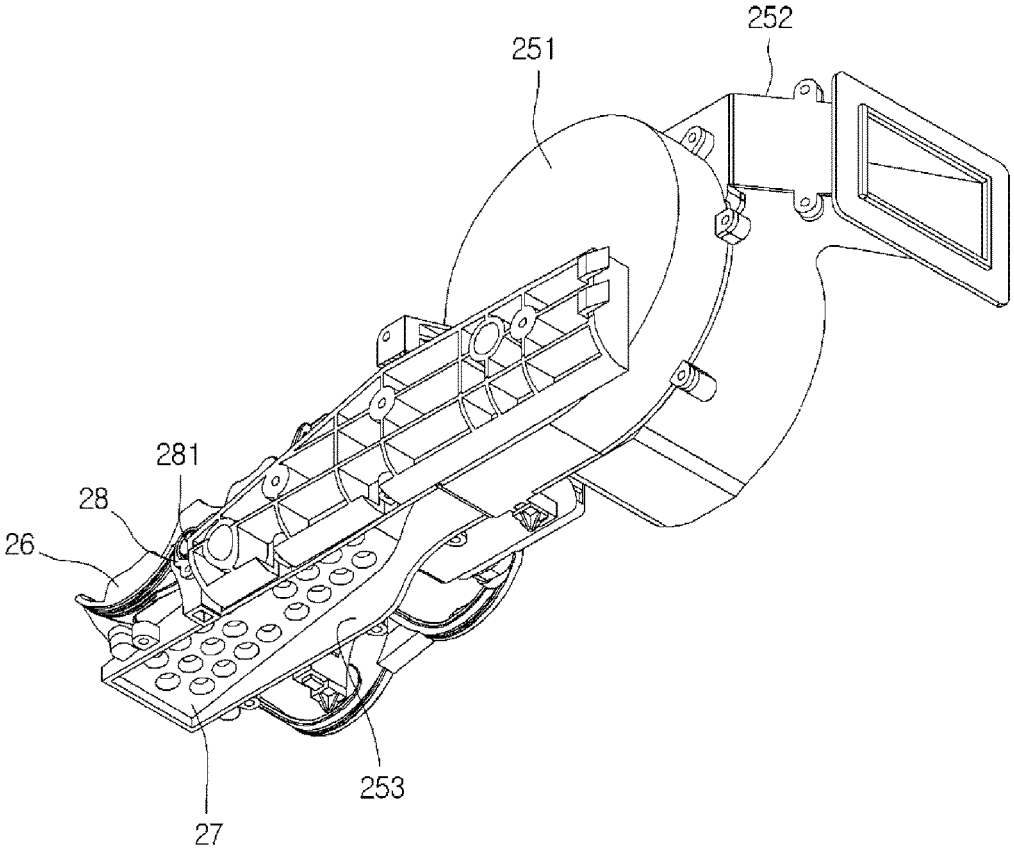

FIG. 2 is a perspective view of the cooling device according to the first embodiment of the present invention, FIG. 3 is a perspective view illustrating the cooling device of which a case is removed, and FIGS. 4 and 5 are bottom perspective views illustrating a mixing member of the cooling device according to the first embodiment of the present invention.

Referring to FIGS. 2 to 5, the cooling device 20 according to the first embodiment of the present invention includes a case 21 whose upper and rear surfaces are opened, a cover 22 which is rotatably connected to a front surface of the case 21, a mixing member 23 which is installed inside the case 21, a driving part 24 which drives the mixing member 23, and a cool air supply part 25 which supplies cool air toward the mixing member 23.

Specifically, an upper surface and a rear surface of the case 21 are opened in the embodiment, but are not limited thereto. That is, only one of the upper surface and the rear surface of the case 21 may be opened. Since one surface of the case 21 is opened, the cool air may be injected to the beverage container loaded on the mixing member 23 through the cool air supply part 25, and then may be discharged to the freezer compartment 112 in which the cooling device 20 is installed. Therefore, a return duct which guides the cool air to be returned from the cooling device 20 to the freezer compartment or an evaporator compartment is not required.

More specifically, in the case of a conventional cooling device, the cool air in the evaporator compartment is guided to the mixing member through a cool air supply duct, and the cool air guided to the mixing member collides with and cools the beverage container, and is then returned to the freezer compartment or the evaporator compartment along the return duct.

However, the cooling device 20 according to the embodiment of the present invention is installed inside the freezer compartment, and has the case 21 of which one surface is opened. Accordingly, an internal space of the case is exposed to the freezer compartment 112. Therefore, it is characterized in that the return duct which enables the cool air guided to the mixing member to be returned to the freezer compartment or the evaporator compartment is not required.

Meanwhile, the cover 22 is rotatably coupled to the front surface of the case 21, and thus a user may open a freezer compartment door of the refrigerator, may swing the cover 22 forward, and then may place the beverage container on the mixing member 23.

Specifically, a hinge shaft may extend to both side ends of the cover 22 so that a rotational center of the cover 22 is transversely formed at a lower end of the cover 22. A front end of the case 21 is formed to be inclined backward toward an upper side thereof. Therefore, when the cover 22 is opened, a surface area through which the internal space of the case 21 is exposed is increased. That is, when a front cross section of the case 21 is formed to be inclined backward, the beverage container may be more easily received or taken out than when the front cross section of the case 21 is formed vertically. A recessed portion may be formed as a grip at a front surface of the case 21, and the cover 22 may be formed of a transparent material so that an inside of the case 22 can be checked.

Hereinafter, the mixing member which is accommodated in the case 22 will be described.

Referring to FIGS. 3 to 5, the mixing member 23 according to the embodiment of the present invention includes a tray 26 on which the beverage container is seated, and a driving part 24 which drives the tray 26.

Specifically, both ends of the tray 26 are reciprocated up and down about a mixing axis by the driving part 24. Hereinafter, such a motion mechanism is defined as a seesaw motion. Since the tray 23 performs the seesaw motion about the mixing axis, the beverage container seated on the tray 23 also performs the seesaw motion. As a result, the beverage filled in the beverage container exchanges heat with the cool air while being mixed. A cooling time of the beverage is determined according to a speed of the seesaw motion of the beverage container, a temperature of the cool air colliding with a surface of the beverage container, and an amount per unit time of the cool air colliding with the beverage container. That is, with an increase in the motion speed of the beverage container, a reduction in the temperature of the cool air, and an increase in the amount of the cool air colliding with the beverage container, a heat exchange amount per unit time between the cool air and the beverage is increased, and thus the cooling time may be reduced.

A structure and function of the tray 26 will be described in detail with reference to the drawings.

The driving part 24 of the mixing member 23 includes a mixing motor 241, a cam 242 which is connected to a rotating shaft of the mixing motor 241, and a driving link 243 which connects the cam 242 with the tray 26.

Specifically, one end of the driving link 243 is connected to a position which is eccentric outward from a center of the cam 242. Therefore, when the rotating shaft of mixing motor 241 is rotated, one end of the driving link 243 revolves around a rotational axis of the cam 242. The other end of the driving link 243 is rotatably connected to a connection end 262, which protrudes from an edge of the tray 26, to reciprocate the tray 26 up and down.

Also, a supporter 28 serving as a mixing central shaft extends from a lower surface of the tray 26. The supporter 28 is fixed to a bottom of the case 21. One or two supporters 28 may be connected to the lower surface of the tray 26. When one supporter 28 is provided, the supporter 28 is located at a center of the tray 26, and when two supporters 28 are provided, the supporters 28 may be located at left and right sides of the lower surface of the tray 26.

The tray 26 is connected to an upper end of the supporter 28 by a mixing shaft 281 to perform the seesaw motion. That is, as the ends of the tray 26 are reciprocated up and down by the driving link 243, the entire tray 26 performs the seesaw motion about the mixing shaft 281.

As indicated by an arrow in FIG. 4, when the cam 242 is rotated clockwise, the tray 26 performs the seesaw motion up and down by the driving link 243. Like this, the tray 26 receives a rotational force of the mixing motor 241, and performs the seesaw motion by a multi-link work.

Meanwhile, the tray 26 is formed to be inclined such that a front end thereof is located at a position lower than a rear end thereof. In other words, even when the driving link 243 which an edge of the tray 26 is connected to is located at a bottom dead point, the edge of the tray 26 to which the driving link 243 is connected is located at a position higher than an opposite edge thereof. Here, an end of the edge located at the low position is the front end of the tray, and an end of an opposite edge is the rear end of the tray. When the beverage container is seated on the tray 26, an opening portion of the beverage container may be disposed toward a rear end of the tray 26 or may be disposed toward left and right sides of the tray 26.

Hereinafter, the cool air supply part 25 will be described.

The cool air supply part 25 is provided to supply the low temperature cool air generated from the evaporator compartment (which will be described later) toward the beverage container at a high speed.

Specifically, the cool air supply part 25 includes a fan housing 251 which accommodates a cooling fan 254, a suction duct 252 which extends from one side of the fan housing 251 and is connected to the evaporator compartment, and a discharge duct 253 which extends from the other side of the fan housing 251 to a lower side of the tray 26. A discharge grille 27 having a plurality of air holes 271 may be separably installed at a discharge port formed at an upper surface of the discharge duct 253. The discharge grille 27 may be installed to be inclined at an angle corresponding to an inclined angle of the tray 26, such that the cool air discharged from the plurality of air holes 271 vertically collides with the surface of the beverage container seated on the tray 26

Figure 6:
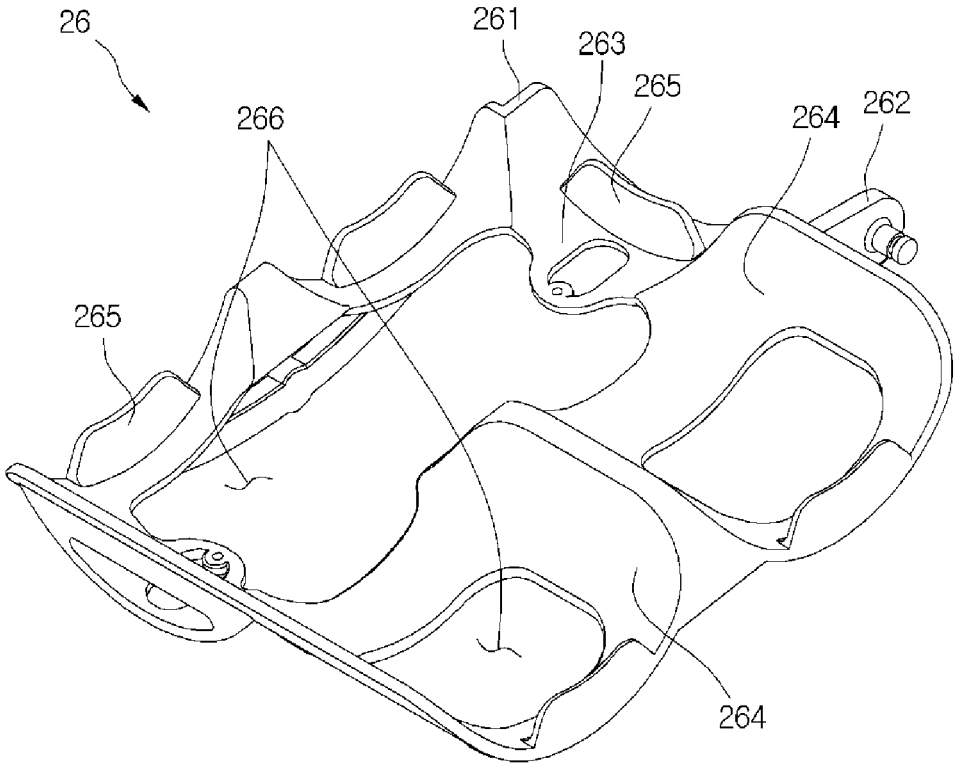
FIG. 6 is a perspective view of a tray included in the cooling device according to the first embodiment of the present invention.

FIG. 6 is a perspective view of the tray included in the cooling device according to the first embodiment of the present invention.

Referring to FIG. 6, the tray 26 of the cooling device 20 according to the first embodiment of the present invention may be formed in an approximately square shape. Specifically, a tray provided in the conventional cooling device 20 is formed to extend in a forward and backward direction to accommodate beverage cans as well as bottled beverages such as wine. However, such a conventional tray causes the cooling device to be long, and thus it is difficult to install the cooling device in a refrigerator having a storage compartment that is short in the forward and backward direction.

However, the embodiment of the present invention provides the tray 26 which may maintain the number of beverage containers to be accommodated, while reducing a length thereof in the forward and backward direction.

Specifically, the tray 26 according to the embodiment of the present invention includes a tray body 261, a first seating part 263 which is formed at the tray body 261 and on which the beverage container is seated in a forward and backward direction of the tray 26, and a second seating part 264 on which the beverage container is seated in a left and right direction of the tray 26. That is, the first seating part 263 and the second seating part 264 are formed in directions crossing each other, specifically orthogonal to each other. The connection end 262 extends from the rear end of the tray 26, and is connected to the driving link 243.

Also, the first seating part 263 may be formed to have a length which extends from the front end of the tray 26 to the rear end thereof, and to also have a width from an edge of one side of the tray 26 to approximately a center thereof. Two second seating parts 264 may be formed at front and rear sides of the tray 26. However, the present invention is not limited thereto, and three or more second seating parts 264 may be formed according to a diameter of the beverage container to be accommodated.

Also, a support rib 265 may be formed to protrude from each of edges of the first seating part 263 and the second seating part 264. The support ribs 265 may serve to prevent the accommodated beverage container from being separated during a mixing process, and may also serve to support a neck portion of a bottle when the bottle having the neck portion is seated.

Also, a cool air passing hole 266 is formed inside the tray body 261, i.e., each of the first seating part 263 and the second seating part 264. Therefore, the cool air injected from the air holes 271 of the discharge grille 27 passes through the cool air passing hole 266, and directly collides with the surface of the beverage container, and thus performs the heat exchange.

Figure 7:
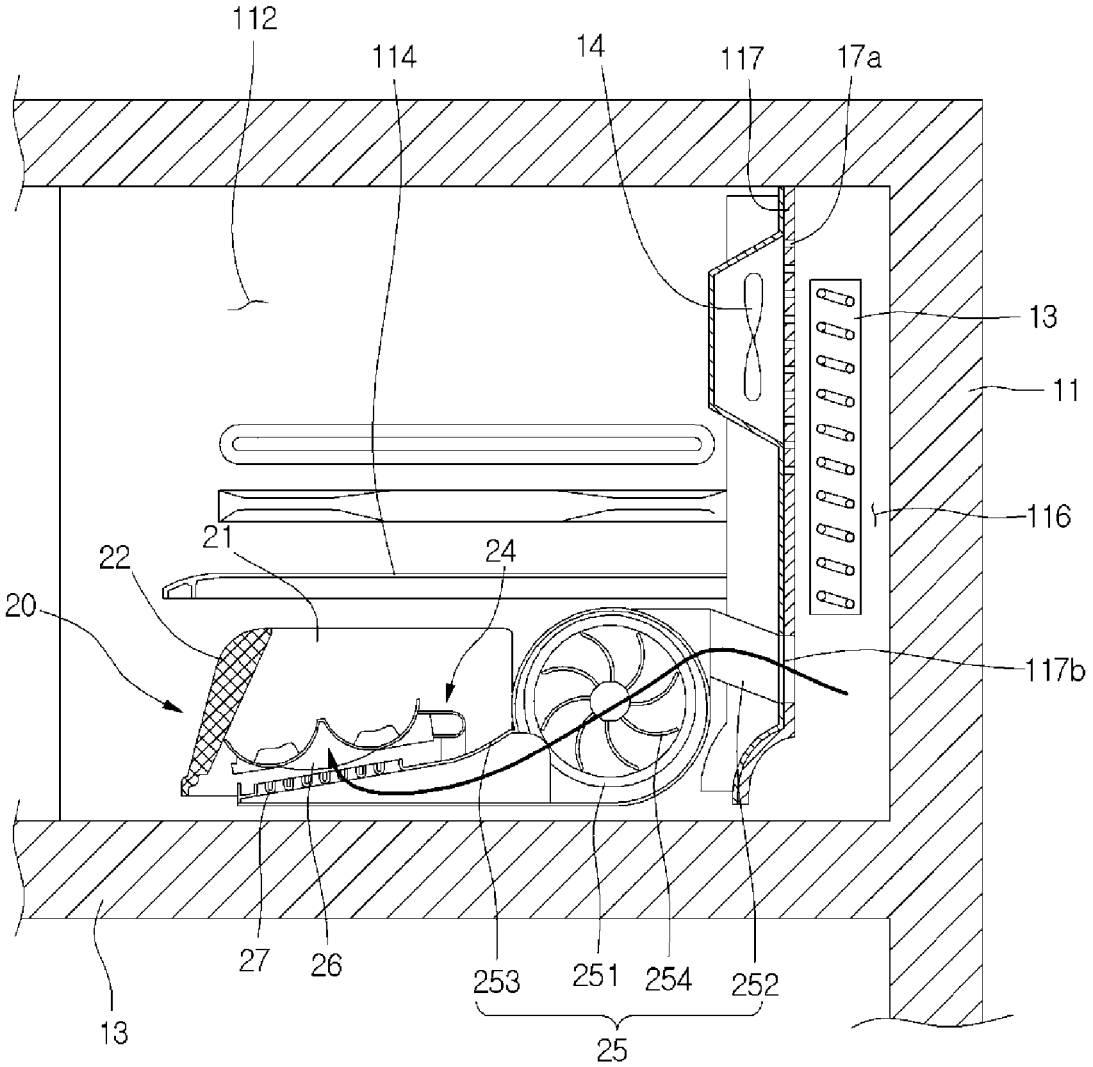
FIG. 7 is a partial longitudinal cross-sectional view of the refrigerator according to the first embodiment of the present invention which is taken along I-I' of FIG. 1.

FIG. 7 is a partial longitudinal cross-sectional view of the refrigerator according to the first embodiment of the present invention which is taken along I-I' of FIG. 1.

Referring to FIG. 7, an evaporator compartment wall 117 is provided at a rear surface of the freezer compartment 112 of the refrigerator according to the first embodiment of the present invention, and the evaporator compartment 116 in which an evaporator 13 is located is formed behind the evaporator compartment wall 117. A cool air discharge hole 117*a* is formed at one side of the evaporator compartment wall 117, and a freezer compartment fan 14 is installed at a front surface of the cool air discharge holes 117*a*. A cool air discharge hole 117*b* is also formed at another one side of the evaporator compartment wall 117, and an inlet end of the suction duct 252 is connected to the cool air discharge hole 117*b*. The cool air in the evaporator compartment 116 is suctioned into the cool air supply part 25 through the cool air discharge hole 117*b*. The cool air supplied to the cooling device 20 cools the beverage container, and then is discharged to the freezer compartment 112 through an opening portion formed at the case 21 of the cooling device 20.

Hereinafter, when the beverage container is received in the cooling device 20, a method for controlling the cooling device in which the cooling time is automatically set according to the number of accommodated beverage containers will be described.

Here, a period of time for cooling the beverage to a predetermined temperature is substantially determined by an amount of the beverage filled in the beverage container, and is not exactly proportional to the number of beverage containers. For example, when a case in which two small-sized beverage cans are accommodated is compared with a case in which one beverage can having a capacity larger than the total capacity of the two cans is accommodated, the latter case has a longer cooling time than the former case. Therefore, a variable which determines the cooling time may be an amount of the accommodated beverage, i.e., a weight of the beverage. Thus, it will be assumed in the following description that the cooling time is set according to a gross weight of a liquid filled in the beverage container accommodated in the cooling device.

Figure 8:
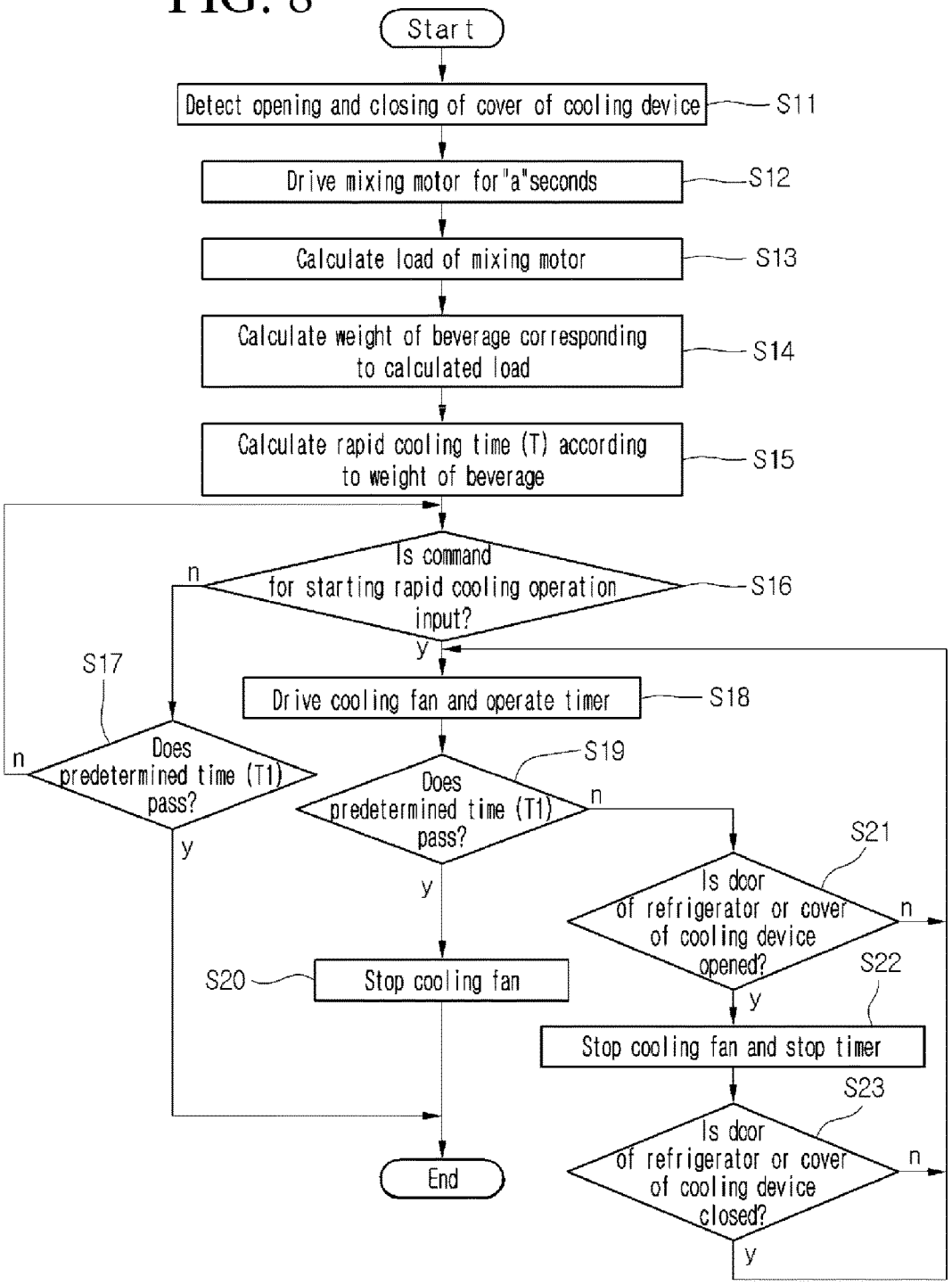
FIG. 8 is a flowchart illustrating a method for controlling the cooling device according to the first embodiment of the present invention.

FIG. 8 is a flowchart illustrating a method for controlling the cooling device according to the first embodiment of the present invention.

Referring to FIG. 8, when opening and closing of the cover 22 of the cooling device 20 is detected (S11), it is detected by a control part (not shown) of the cooling device or the refrigerator. A detecting method may be performed in various methods. For example, a principle in which an indoor lamp of the refrigerator is turned on when a refrigerator door is opened may be equally applied. That is, a cover open detecting switch may be installed at a portion in which the case 21 and the cover 22 are in contact with each other to detect ON/OFF of the switch and thus an opening and closing state of the cover 22.

When the opening of the cover 22 is detected, the beverage container is regarded as being accommodated in the case 21, and the mixing motor 241 is controlled to be driven for a predetermined time (a seconds) and then to be stopped (S12). A load of the mixing motor generated by driving the mixing motor 241 is calculated (S13). In a memory of the control part, the weight of the beverage according to the load of the mixing motor is stored in the form of a look-up table. Therefore, when the load of the mixing motor applied at an initial driving stage is calculated, the weight of the liquid filled in the accommodated beverage container is also automatically calculated (S14).

The rapid cooling time according to the calculated weight of the beverage is also stored in the memory of the control part in the form of a look-up table, and thus the rapid cooling time may be automatically calculated using the look-up table (S15).

In this state, it is determined whether a command for starting a rapid cooling operation is input by a user (S16). Here, a button member for inputting the command for starting the rapid cooling operation may be provided at a front surface of the cover 22 of the cooling device 20 or may be separately provided at a display part or a control panel which is provided at a front surface of the refrigerator door. Of course, even if the command for starting the rapid cooling operation is not input through the button member, when the rapid cooling time is calculated and the closing of the cover 22 is detected, the cooling operation may be immediately performed.

Specifically, when the closing of the cover 22 is detected and the command for starting the rapid cooling operation is not input, an operation which detects for a predetermined time T1 whether the command for starting the rapid cooling operation is input is performed (S17). When it is determined that the command for starting the rapid cooling operation is not input even after the predetermined time T1, a rapid cooling control operation may be automatically terminated.

Meanwhile, when the closing of the cover 22 is detected and the command for starting the rapid cooling operation is input, the cooling fan 254 is driven, and a timer (not shown) is operated (S18). Whether the rapid cooling time T according to the weight of the beverage passes is detected in real time (S19). When it is determined that the predetermined time T passes, the cooling fan 254 is stopped (S20), and the rapid cooling control operation is terminated.

However, when the predetermined time T does not pass, whether an opening signal of the refrigerator door or the cover 22 of the cooling device is input is periodically detected until it reaches the predetermined time T (S21). This is to minimize leakage of the low temperature cool air supplied during the rapid cooling operation to an outside of the case 21 due to the opening of the refrigerator, in particular, a door of the freezer compartment or the cover 22.

When a detecting signal which informs of the opening of the refrigerator door or the cover 22 of the cooling device is transmitted to the control part during the rapid cooling operation, the cooling fan 254 and the timer are temporarily stopped (S22). When a signal that the refrigerator door or the cover 22 of the cooling device is closed is input (S23), the cooling fan is driven again, and an operation of the timer is resumed. When a driving time of the cooling fan reaches the predetermined time T, the cooling fan is stopped, and the timer is reset.

As described above, since the weight of the beverage accommodated in the cooling device is automatically detected using the load applied to the mixing motor, and thus a cooling operation time is automatically calculated, it is not necessary to manually input the number of accommodated beverage containers.

Figure 9:
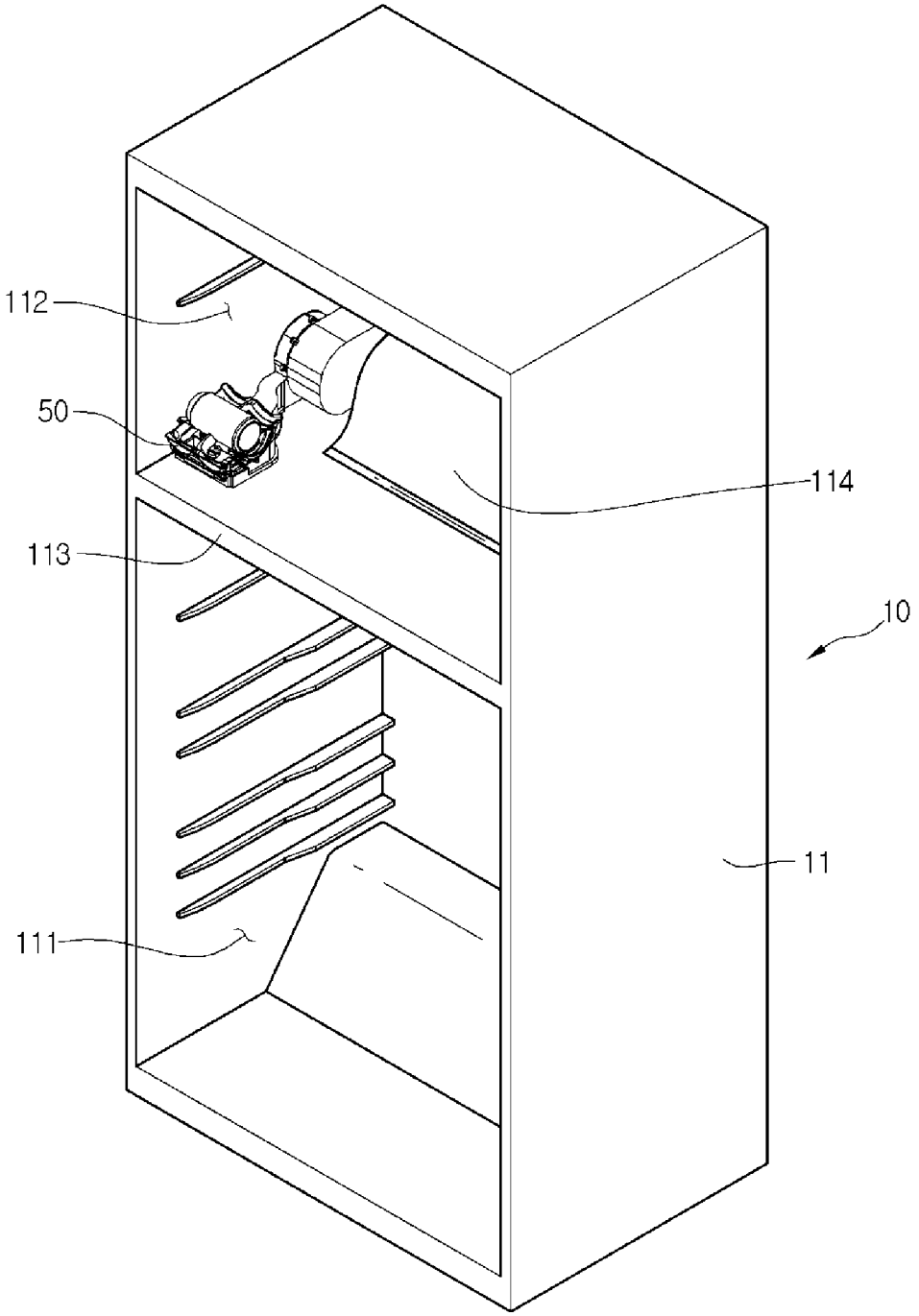
FIG. 9 is a perspective view illustrating an inside of a refrigerator equipped with a cooling device according to a second embodiment of the present invention.

FIG. 9 is a perspective view illustrating an inside of a refrigerator equipped with a cooling device according to a second embodiment of the present invention.

Referring to FIG. 9, a cooling device 50 according to the embodiment of the present invention may be installed at a bottom of a freezer compartment 112, and may be located at an edge of one side of the freezer compartment 112. One or more shelves 114 may be disposed above the cooling device 50. The cooling device 50 according to another embodiment of the present invention has a structure in which the beverage container filled with the beverage is exposed to the inside of the freezer compartment 112. Therefore, a cool air path in which the cool air injected to the beverage container is mixed with the cooling air in the freezer compartment 112 and then returned to the evaporator compartment is formed.

Also, the refrigerator compartment 111 and the freezer compartment 112 may be divided by a mullion 113, and the plurality of shelves or drawers may also be disposed inside the refrigerator compartment 111.

Figure 10:
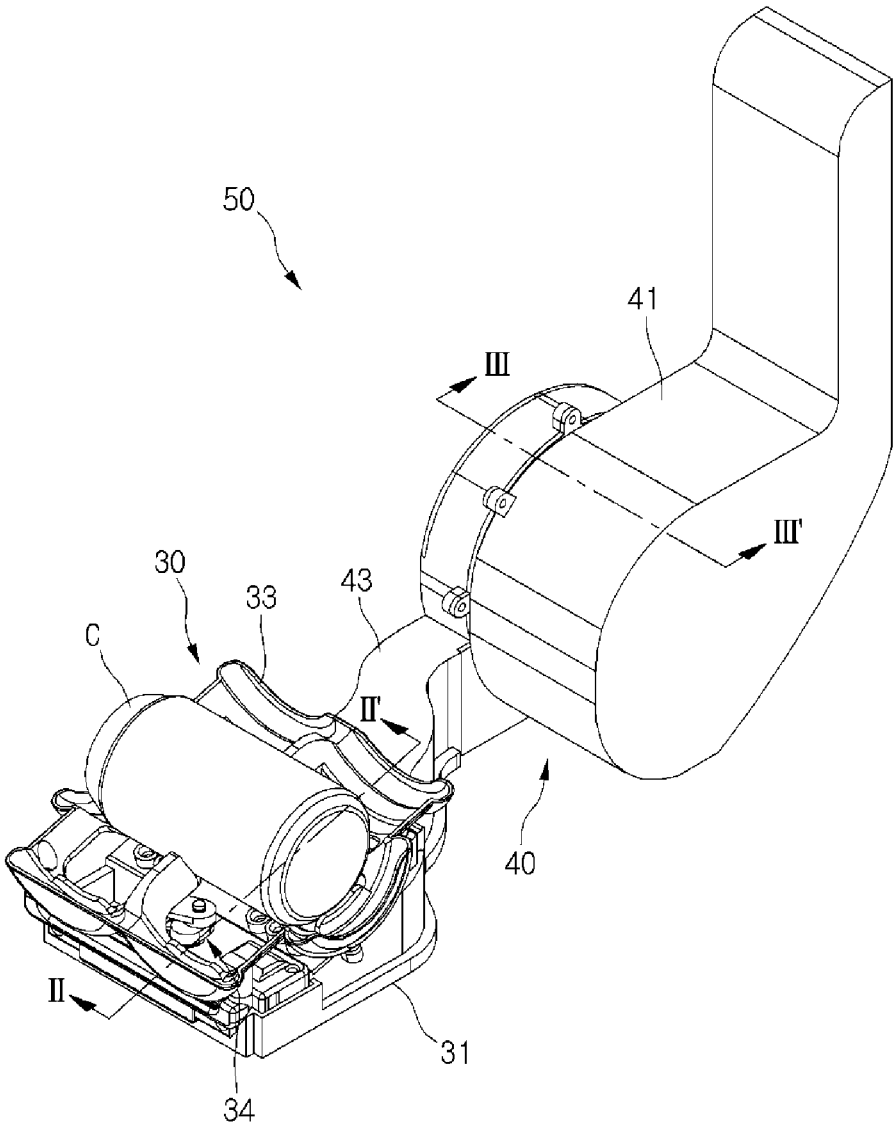
FIG. 10 is a perspective view of the cooling device according to the second embodiment of the present invention.

FIG. 10 is a perspective view of the cooling device according to the second embodiment of the present invention.

Referring to FIG. 10, the cooling device 50 according to the second embodiment of the present invention includes a mixing unit 30 which shakes a beverage container C, and a cool air supply unit 40 which supplies cool air to the mixing unit 30. The cool air supply unit 40 is in communication with an evaporator compartment (not shown) provided at a rear surface of the freezer compartment 112 to suction and supply the cool air in the evaporator compartment to the mixing unit 30. The cool air supply unit 40 includes a suction duct 41 which suctions the cool air in the evaporator compartment, a fan assembly 42 (referring to FIG. 15) which is provided inside the suction duct 41, and a discharge duct 43 which extends from a discharge end of the fan assembly 42 to the mixing unit 30. A structure of the fan assembly 42 will be described below in detail with reference to the drawings.

Meanwhile, the mixing unit 30 includes a base 31 provided at the discharge end of the discharge duct 43, a tray 33 which is installed at an upper side of the base 31 to be shaken and on which the beverage container C is placed, and a driving unit 34 which shakes the tray 33. When the driving unit 34 is operated, the tray 33 slidingly reciprocates up and down on an upper surface of the base 31, and shakes the beverage container C. Hereinafter, the driving unit 34 and a structure thereof will be described in detail with reference to the drawings.

Figure 11:
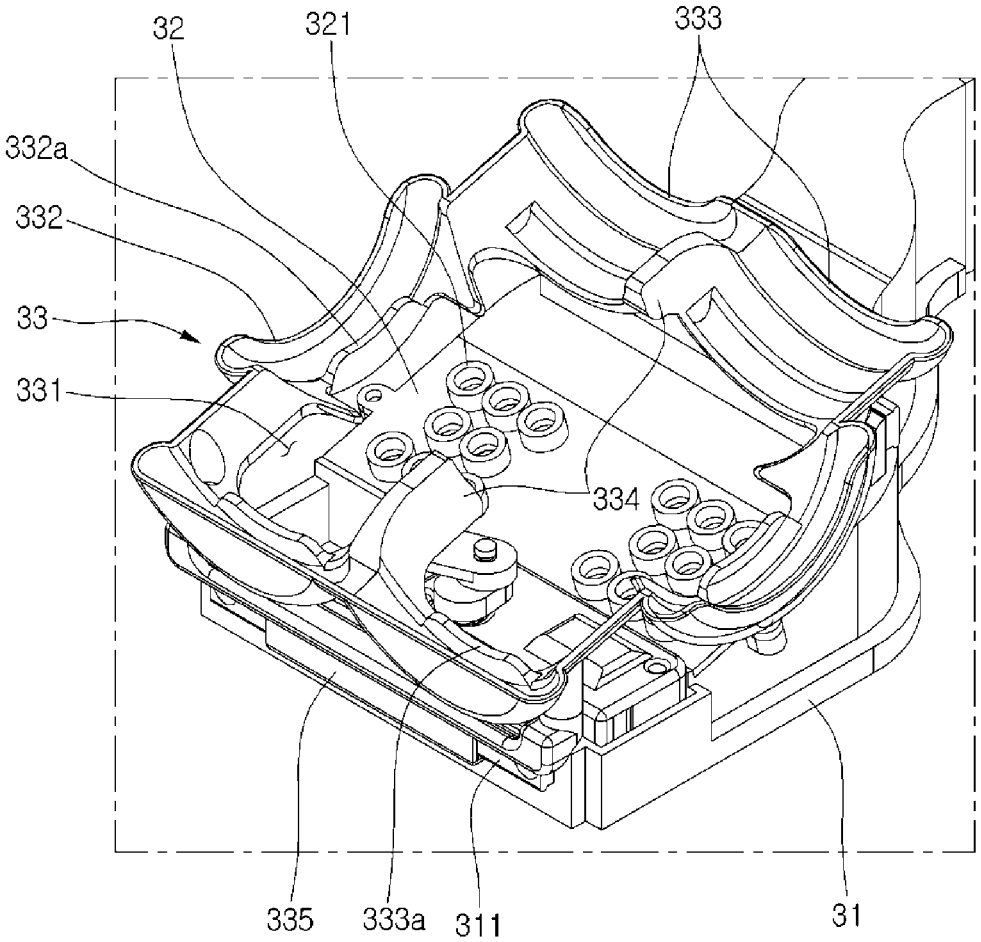
FIG. 11 is an enlarged perspective view illustrating a mixing unit of the cooling device according to the second embodiment of the present invention.

FIG. 11 is an enlarged perspective view illustrating the mixing unit of the cooling device according to the second embodiment of the present invention.

Referring to FIG. 11, the tray 33 included in the mixing unit 30 is disposed at the upper side of the base 31.

Specifically, the discharge end of the discharge duct 43 is connected to a rear surface of the base 34, and a guide rail 311 which guides a sliding reciprocating motion of the tray 33 is formed at front and rear surfaces of the base 31.

Also, a discharge grille 32 is coupled to the upper surface of the base 31, and a plurality of discharge ports 321 are formed at the discharge grille 32. Here, each of the discharge ports 321 is characterized in that it is formed in a boss or nozzle shape. Each of the discharge ports 321 is formed in a cylindrical shape having a constant diameter or a truncated cone shape of which a diameter is gradually reduced toward an end thereof. Therefore, an injection speed and pressure of the cool air discharged through the discharge ports 321 is considerably increased. The cool air discharged from the discharge ports 321 collides with a surface of the beverage container and exchanges heat with a beverage. The cool air injected through the discharge ports 321 may collide with the surface of the beverage container at a high speed, and thus may cool the surface of the beverage container in a short time. Here, the discharge ports 321 are formed to be biased to left and right ends of the discharge grille 32. Therefore, when one beverage container C is transversely displaced at a center of the tray 33, the cool air injected at the high speed collides with left and right surfaces of the beverage container C, and thus a heat exchange area is increased. Further, when the beverage containers are longitudinally seated in parallel with each other on left and right sides of the tray 33, the cool air may be injected to a center portion of each of the beverage containers.

Meanwhile, a cool air guide hole 331 is formed inside the tray 33 so that the cool air injected from the discharge ports 321 collides with the surface of the beverage container.

Specifically, the tray 33 includes a container support part on which one or a plurality of beverage containers may be seated. The container support part includes a first container support part 332 which enables one beverage container to be transversely displaced at the center of the tray 33, and one pair of second container support parts 333 which enable two beverage containers to be displaced in parallel in a forward and backward direction of the tray 33. Support ribs 332*a* and 333*a* which protrude to support an end of each beverage container may be formed at the container support parts. The pair of second container support parts 333 may be divided into a left support part and a right support part by a partition rib 334. The partition rib 334 may be formed to extend from a front end and a rear end of the tray 33 toward the center thereof by a predetermined length. A bottom of each of the container support parts may be formed to be concavely recessed or curved with a predetermined curvature and thus to accommodate the cylindrical beverage container.

Also, a slider 335 which is slid left and right along the guide rail 311 of the base 31 is formed at front and rear surfaces of the tray 33. The slider 335 may be formed to have a "⊏"-shaped longitudinal cross section, and thus to cover the rail 311.

As described above, the discharge ports 321 are formed to be biased to left and right sides of the discharge grille 32 in consideration of both the case in which one beverage container is placed thereon and the case in which two beverage containers are placed thereon. That is, when one beverage container is placed thereon, all of the cool air injected through the discharge ports 321 is enabled to collide with the surface of the beverage container, and when two beverage containers are placed thereon, the cool air injected through the discharge ports 321 is enabled to collide with the surface of each of the beverage containers. Assuming that the discharge ports 32 are formed at a center of the discharge grille 32, when the two beverage containers are placed thereon, some of the cool air does not collide with the beverage container, but is discharged between the two beverage containers. Therefore, heat exchange efficiency may be reduced, and a time required to rapidly cool the beverage may be increased.

Figure 12:
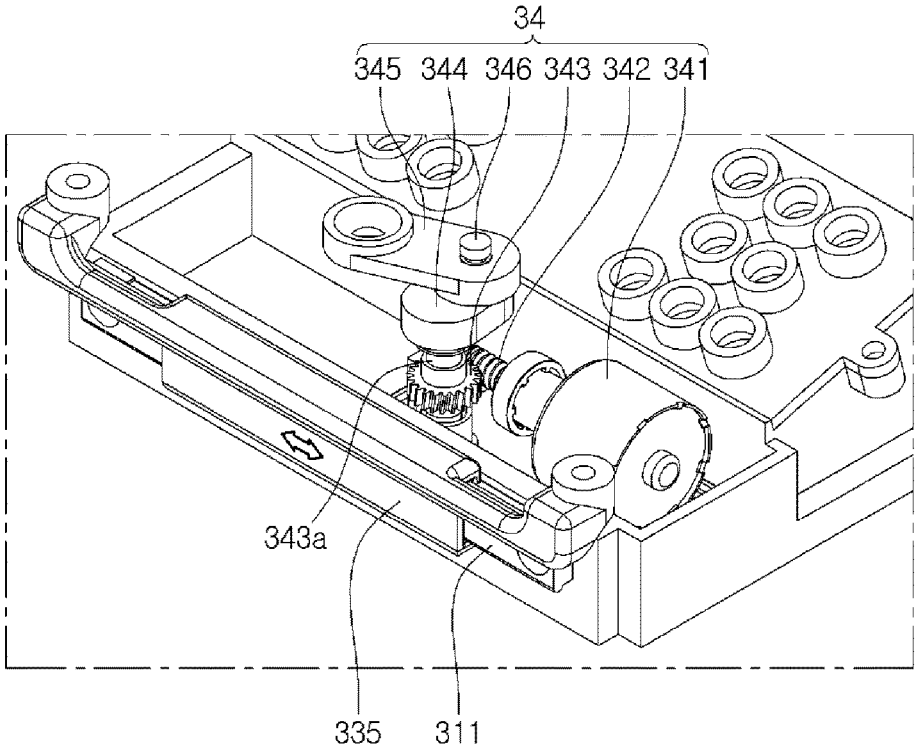
FIGS. 12 and 13 are perspective views illustrating a driving unit of the cooling device according to the second embodiment of the present invention.
Figure 13:
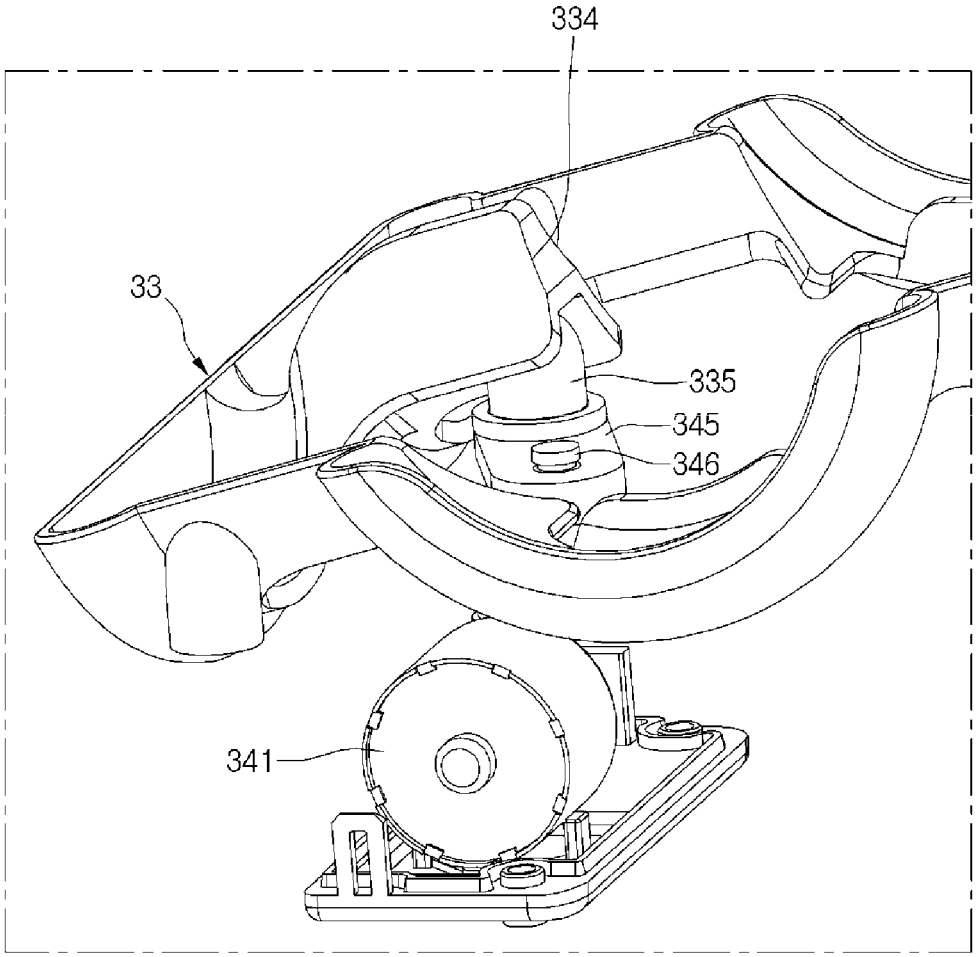

FIGS. 12 and 13 are perspective views illustrating the driving unit of the cooling device according to the second embodiment of the present invention.

Referring to FIGS. 12 and 13, the driving unit 34 of the cooling device 50 according to the second embodiment of the present invention includes a mixing motor 341 which generates power, and a power transmission unit which is connected to a motor shaft 342 of the mixing motor 341.

Specifically, the power transmission unit includes a switching gear 343 which is connected to the motor shaft 342, a first link 344 which is connected to an end of a gear shaft 343*a* of the switching gear 343, and a second link 345 of which one end is connected to the first link 344 through a connection shaft 346.

More specifically, the motor shaft 342 of the mixing motor 341 and the switching gear 343 are formed in a coupling type between a worm and a worm gear to enable a power transmission direction to be vertically switched. The gear shaft 343*a* may extend from a rotational center of the switching gear 343. However, the present invention is not limited thereto, and the mixing motor 341 may be provided uprightly, and the first link 344 may be directly connected to an end of the motor shaft 342.

Meanwhile, a two-bar link structure in which an end of the gear shaft 343*a* is connected to one end of the first link 344, and one end of the second link 345 is connected to the other end of the first link 344 may be formed. Specifically, one end of the second link 345 may be placed on an upper surface of the other end of the first link 344, and the connection shaft 346 may pass through the second link 345 and the first link 344.

Also, as illustrated in FIG. 13, a connection end 335 which protrudes from a lower surface of the tray 33 may be connected to the other end of the second link 345. The connection end 335 may extend from the lower surface of the partition rib 334 by a predetermined length, and may be coupled to the other end of the second link 345.

According to the above-described structure, electric power is applied to the mixing motor 341, the motor shaft 342 is rotated, and the switching gear 343 gear-coupled to the motor shaft 342 is rotated. The gear shaft 343*a* is rotated according to rotation of the switching gear 343, and the first link 344 connected to the gear shaft 343*a* is rotated. One end of the second link 345 revolves around the gear shaft 343*a* according to rotation of the first link 344. If one end of the second link 345 revolves around the gear shaft 343*a* by the first link 344, the tray 33 connected to the other end of the second link 345 linearly reciprocates left and right. Here, the slider 335 formed at the front and rear surfaces of the tray 33 is slid left and right along the guide rail 311 formed at the front and rear surfaces of the base 31.

More specifically, a moment at which one end of the first link 344, i.e., the end thereof connected with the second link 345, is rotated and becomes in parallel with the motor shaft 342 is a point in time at which the tray 33 is maximally moved. In other words, when the first link 344 is rotated clockwise in the drawing, and the other end of the first link 344 is in parallel with the motor shaft 342 at a position closest to the mixing motor 341, the tray 33 is located at a point which is maximally moved right. When the first link 344 is further rotated and the other end of the first link 344 is in parallel with the motor shaft 342 at a position farthest from the mixing motor 341, the tray 33 is located at a point which is maximally moved left.

Figure 14:
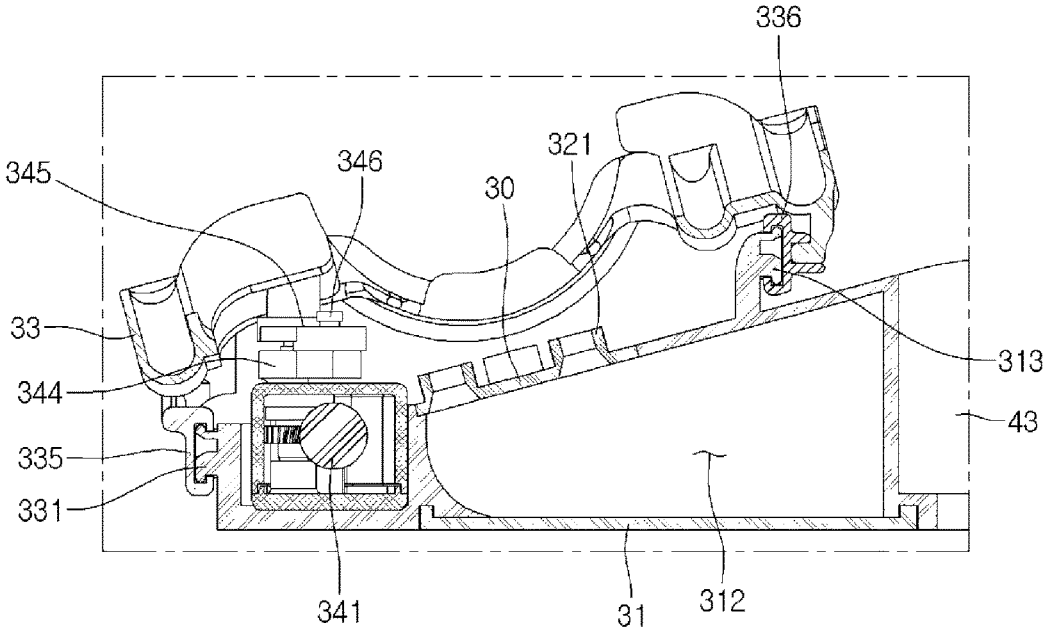
FIG. 14 is a side cross-sectional view taken along II-II' of FIG. 10.

FIG. 14 is a side cross-sectional view taken along II-II' of FIG. 10.

Referring to FIG. 14, a cool air chamber 312 is formed inside the base 31 of the cooling device 50 according to the second embodiment of the present invention.

Specifically, the discharge end of the discharge duct 43 is connected to a rear end of the base 31, and the discharge duct 43 and the cool air chamber 312 are in communication with each other. Therefore, the cool air supplied through the discharge duct 43 is moved to the cool air chamber 312. An upper surface of the cool air chamber 312 is opened and covered by the discharge grille 32. Accordingly, the air guided to the cool air chamber 312 is injected at the high speed through the discharge ports 321. The cool air injected from the discharge ports 321 at the high speed collides with the surface of the beverage container C. Since the cool air is injected at the high speed through the discharge ports 321, the discharge ports 321 may be referred to as jet-holes.

Meanwhile, guide rails 311 and 313 are formed at a front surface and a rear upper surface of the base 31, respectively, and sliders 335 and 336 are formed at a lower end of a front surface and a rear surface of the tray 33, respectively. The sliders 335 and 336 are coupled to the guide rails 311 and 313, respectively, and slid left and right. Although not shown in the drawing, a friction reducing member such as a ball bearing may be provided at portions in which the sliders 335 and 336 are in contact with the guide rails 311 and 313. Since the ball bearing is provided between the sliders and the guide rails, a friction area is reduced, and thus the sliders 335 and 336 may be smoothly moved along the guide rails 311 and 313.

Also, the upper surface of the base 31 is formed to be inclined down toward a front end thereof. Therefore, while a lower end of the beverage container seated on the tray 33 is located lower than an upper end thereof, the beverage container is shaken left and right. This enables the upper end of the beverage container to be seated higher than the lower end thereof, thereby preventing leakage of the beverage from the beverage container, and also enables the user to easily insert or remove the beverage container. That is, when the lower end of the beverage container is seated lower than the upper end thereof, the user may easily recognize the beverage container, and may also easily load or take out the beverage container on or from the tray.

Figure 15:
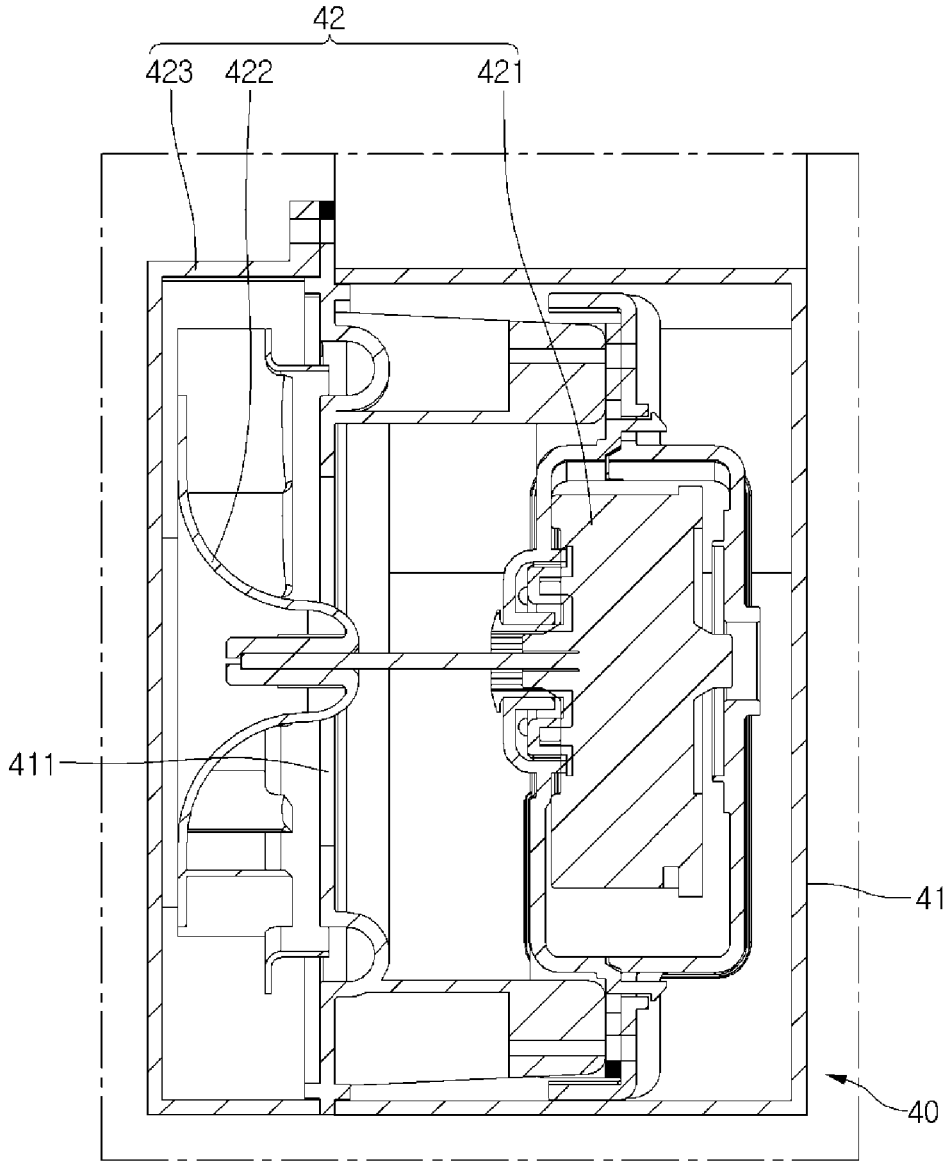
FIG. 15 is a longitudinal cross-sectional view taken along III-III' of FIG. 10.

FIG. 15 is a longitudinal cross-sectional view taken along III-III' of FIG. 10, and illustrates the fan assembly provided at the cooling device according to the second embodiment of the present invention.

Referring to FIG. 15, the fan assembly 42 is installed at the suction duct 41 included in the cool air supply unit 40.

Specifically, the fan assembly 42 includes a fan housing 423 which is connected to one side of the suction duct 41, a cooling fan 422 which is installed inside the fan housing 423, and a fan motor 421 which rotates the cooling fan 422. The fan motor 421 may be accommodated in the suction duct, and the cooling fan 422 may be a centrifugal fan which axially suctions the cool air and then radially discharges the cool air. A discharge end of the fan housing 423 is in communication with a suction end of the discharge duct 43.

More specifically, one end of the suction duct 41 may be in communication with the evaporator compartment, and the other end thereof may be blocked, and the fan motor 421 may be installed inside the suction duct 41 corresponding to the other end thereof. A communication hole 411 is formed at a side surface of the suction duct 41, and the fan housing 423 is installed outside the communication hole 411. Therefore, the cool air suctioned through the suction duct 41 passes through the communication hole 411, and a flow thereof is switched in a radial direction of the cooling fan 422 and guided to an entrance end of the discharge duct 43. The cool air flowing through the discharge duct 43 is moved to the cool air chamber 312 of the base 31, and then injected to the beverage container through the discharge ports 321.

Characteristics of the cooling device according to the second embodiment are as follows.

The cooling device according to the second embodiment of the present invention includes a base in which cool air discharge ports are formed at an upper surface thereof; a tray located above the base, having a container support part on which a beverage container is placed, and configured to be able to linearly reciprocate while connected with the base; a driving unit configured to enable the tray to linearly reciprocate; a guide part configured to guide a linear reciprocating motion of the tray; and a cool air supply unit connected to one side of the base and configured to guide low temperature cool air toward the base, and the guide part may include sliders provided at the tray, and guide rails provided at one side of the base corresponding to positions of the sliders, coupled with the sliders, and configured to guide movement of the sliders.

The storage compartment may be a freezer compartment.

The sliders may be formed at a front end and a rear end of the tray, and the guide rails may be formed at one side of the upper surface of the base corresponding to the positions of the sliders.

The cooling device may further include a ball bearing provided at portions in which the sliders and the guide rails are in contact with each other.

The upper surface of the base may be formed to be inclined such that a front end thereof is located lower than a rear end thereof.

A cool air chamber may be formed inside the base, and an upper surface of the cool air chamber may be opened.

The cooling device may further include a discharge grille which covers the opened upper surface of the cool air chamber, and the cool air discharge ports may be formed at the discharge grille.

Each of the cool air discharge ports may be formed in a boss or nozzle shape.

The cool air discharge ports may be disposed at left and right areas of the discharge grille.

The tray may include a cool air guide hole through which the cool air passes, a first container support part in which one beverage container is placed in a left and right direction, one pair of second container support parts in which two beverage containers are disposed in parallel with each other in a forward and backward direction, and a support rib which protrudes from each of the first and second container support parts.

The pair of second container support parts may be divided by a partition rib.

The air supply unit may include a suction duct of which an entrance end is connected to an evaporator compartment of a refrigerator, a fan housing which is connected to a discharge end of the suction duct, a cooling fan which is accommodated in the fan housing, a fan motor which is accommodated inside the suction duct to drive the cooling fan, and a discharge duct of which an entrance end is connected to a discharge end of the fan housing, and a discharge end is connected to an entrance end of the cool air chamber.

The driving unit may include a mixing motor, a gear shaft which receives a rotational force of the mixing motor to be rotated, a first link of which one end is connected to an end of the gear shaft, and a second link of which one end is connected to the other end of the first link, and the other end of the second link may be connected to a lower surface of the tray.

Figure 16:
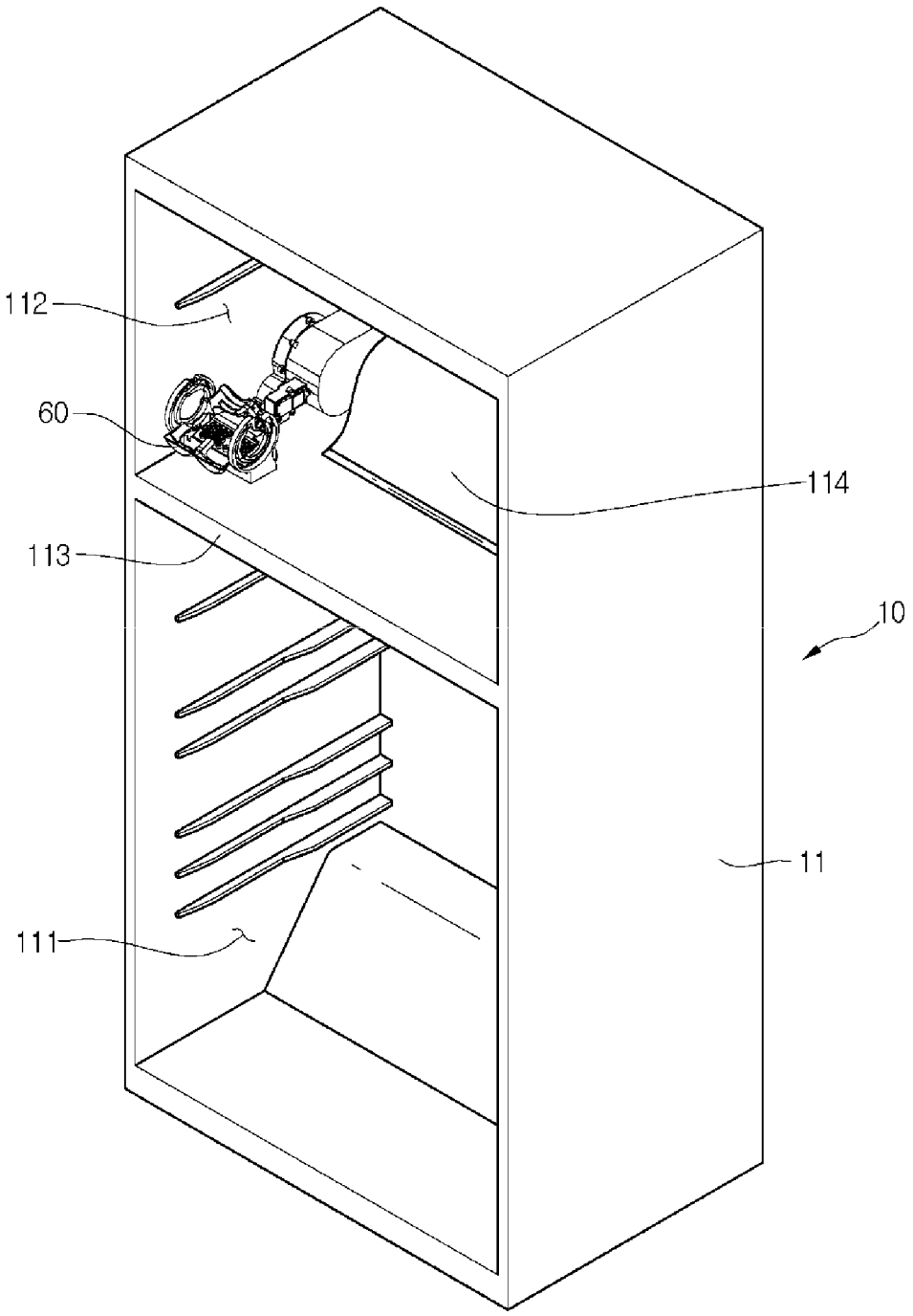
FIG. 16 is a perspective view illustrating an inside of a refrigerator equipped with a cooling device according to a third embodiment of the present invention.

FIG. 16 is a perspective view illustrating an inside of a refrigerator equipped with a cooling device according to a third embodiment of the present invention.

Referring to FIG. 16, a refrigerator 10 equipped with a cooling device according to a third embodiment of the present invention includes a main body 11, and a cooling device 60 which is installed inside the main body 11 to perform a rapid cooling operation.

Figure 17:
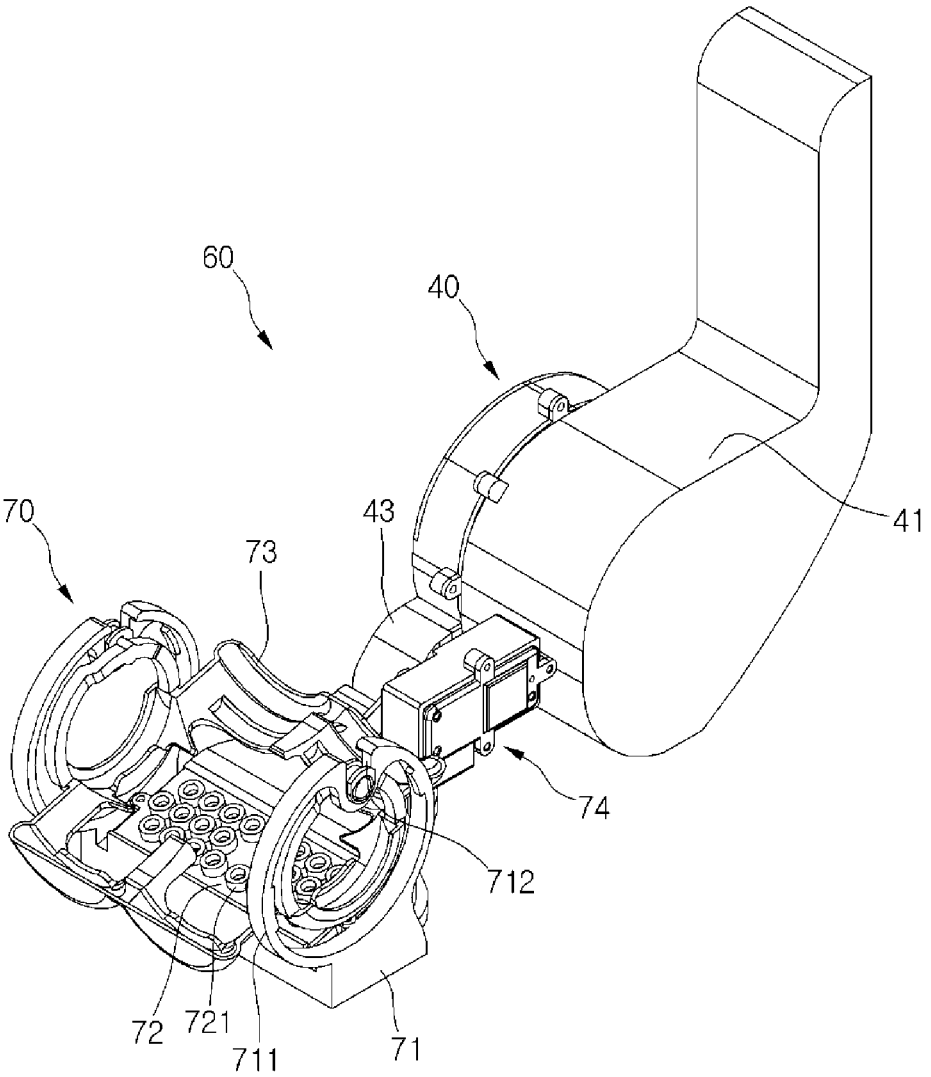
FIG. 17 is a front perspective view of the cooling device according to the third embodiment of the present invention.
Figure 18:
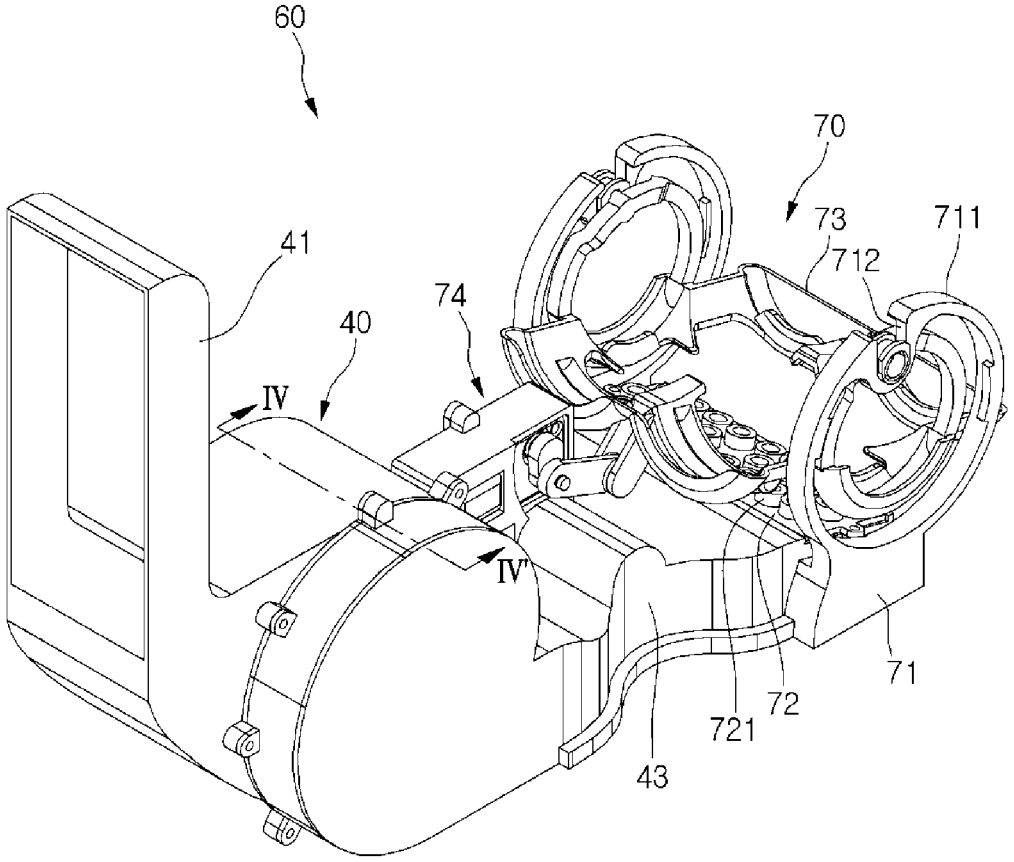
FIG. 18 is a rear perspective view of the cooling device.

FIG. 17 is a front perspective view of the cooling device according to the third embodiment of the present invention, and FIG. 18 is a rear perspective view of the cooling device.

Referring to FIGS. 17 and 18, the cooling device 60 according to the third embodiment of the present invention includes a mixing unit 70 which shakes a beverage container, and a cool air supply unit 40 which supplies cool air to the mixing unit 70. The cool air supply unit 40 is in communication with an evaporator compartment (not shown) provided at a rear surface of the freezer compartment 112 to suction and supply the cool air in the evaporator compartment to the mixing unit 70. The cool air supply unit 40 includes a suction duct 41 which suctions the cool air in the evaporator compartment, a fan assembly 42 (referring to FIG. 20) which is provided inside the suction duct 41, and a discharge duct 43 which extends from a discharge end of the fan assembly 42 to the mixing unit 70. A structure of the fan assembly 42 will be described below in detail with reference to the drawings.

Meanwhile, the mixing unit 70 includes a base 71 provided at the discharge end of the discharge duct 43, a tray 73 which is installed at an upper side of the base 71 to be shaken and on which the beverage container is placed, and a driving unit 74 which shakes the tray 73. When the driving unit 74 is operated, the tray 73 performs a pendulum motion above the base 71 in a forward and backward direction, and shakes the beverage container. Here, the motion of the tray 73 may be defined as a swing motion. Hereinafter, the driving unit 74 and a structure thereof will be described in detail with reference to the drawings.

A cool air chamber (not shown) is formed inside the base 71. The cool air chamber is in communication with a discharge end of the discharge duct 43. An upper surface of the base 71 is opened, and the opened surface is covered by a discharge grille 72. A plurality of discharge ports 721 are formed at the discharge grille 72. Each of the discharge ports 721 is characterized in that it is formed in a boss or nozzle shape which protrudes from an upper surface of the discharge grille 72 by a predetermined length. Each of the discharge ports 721 is formed in a cylindrical shape having a constant diameter or a truncated cone shape of which a diameter is gradually reduced toward an end thereof. Therefore, an injection speed and pressure of the cool air discharged through the discharge ports 721 is considerably increased. The cool air discharged from the discharge ports 721 collides with a surface of the beverage container seated on the tray 73 and exchanges heat with a beverage. The cool air injected through the discharge ports 721 may collide with the surface of the beverage container at a high speed, and thus may cool the surface of the beverage container in a short time.

Also, the upper surface of the base 71 is formed to be inclined down toward the front end thereof. In a basic state before an operation, the tray 73 is also maintained to be inclined down toward the front end thereof. A swing amount (a rotation angle) may be set so that, in a shaking process, while a rear end of the tray 73 is swung to the lowest point, the tray 73 is in at least a horizontal state or an inclined state before the horizontal state. Therefore, the tray performs the swing motion while a state in which the lower end of the beverage container seated on the tray 73 is located lower than the upper end thereof is maintained. As the beverage container is seated so that the upper end thereof is located higher than the lower end thereof, leakage of the beverage from the beverage container may be prevented, and also the user may easily seat the beverage container or may easily take out the beverage container. That is, when the beverage container is seated so that the lower end thereof is located lower than the upper end thereof, the user may easily recognize the beverage container, and may also easily load or take out the beverage container on or from the tray.

Also, a tray support part 711 which supports the tray 73 to allow the tray 73 to perform the pendulum motion, i.e., the swing motion, at a position at which the tray 73 is spaced apart from the upper surface of the base 71 is formed to extend from upper surfaces of both side ends of the base 71. The tray support part 711 may be formed in a circular shape, as described in the drawing, or may be formed in various shapes including a triangular shape and a quadrangular shape. A mixing shaft seating groove 712 may be formed at an upper end of the tray support part 711 to be recessed, and thus a mixing shaft 737 (referring to FIG. 19) of the tray 73 may be seated therein. A bottom of the mixing shaft seating groove 712 may be curved with a curvature corresponding to a curvature of the mixing shaft 737 so that the mixing shaft 737 is smoothly rotated. If necessary, a friction reducing member such as a ball bearing may be provided at a portion in which the mixing shaft 737 is in contact with the mixing shaft seating groove 712.

Figure 19:
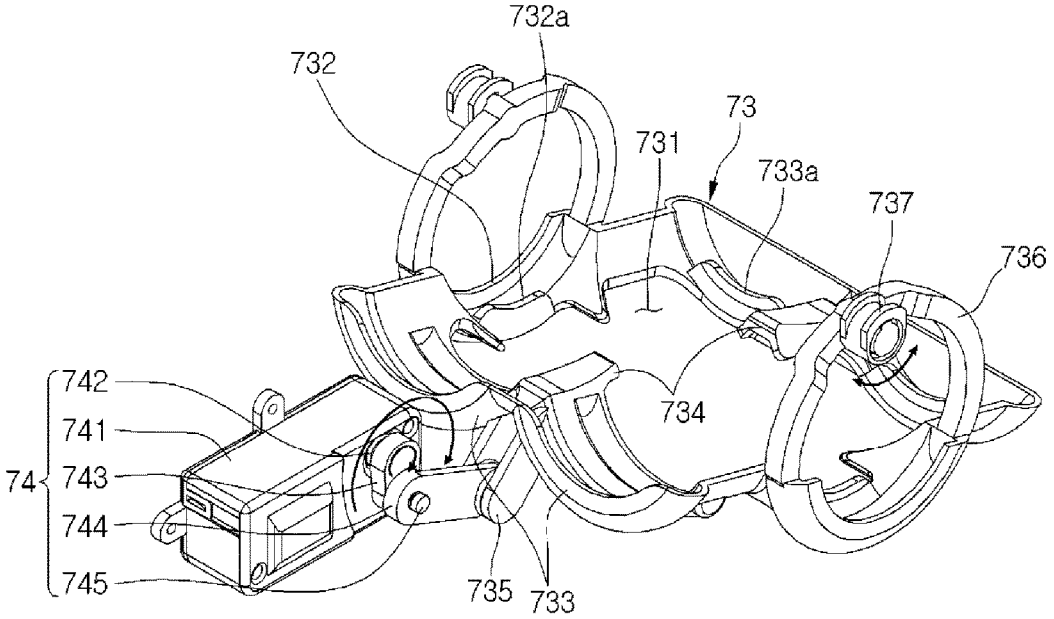
FIG. 19 is a perspective view illustrating a connection state between a tray and a driving unit which are included in the cooling device according to the third embodiment of the present invention.

FIG. 19 is a perspective view illustrating a connection state between the tray and the driving unit which are included in the cooling device according to the third embodiment of the present invention.

Referring to FIG. 19, the tray 73 of the cooling device 60 according to the third embodiment of the present invention may be formed in an approximately quadrangular shape.

Specifically, a cool air guide hole 731 is formed inside the tray 73 so that the cool air injected from the discharge ports 721 collides with the surface of the beverage container.

Also, the tray 73 includes a container support part on which one or a plurality of beverage containers may be seated. The container support part includes a first container support part 732 which enables one beverage container to be transversely displaced at a center of the tray 73, and one pair of second container support parts 733 which enable two beverage containers to be displaced in parallel in a forward and backward direction of the tray 73. The pair of second container support parts 733 may be divided into a left support part and a right support part by a partition rib 734. The partition rib 734 may be formed to extend from a front end and the rear end of the tray 73 toward the center thereof by a predetermined length. A bottom of each of the container support parts may be formed to be concavely recessed or curved with a predetermined curvature and thus to accommodate the cylindrical beverage container.

Also, a supporter 736 is formed at both side ends of the tray 73 to extend upward, and the mixing shaft 737 is formed at an outer side surface of an upper end of the supporter 736 to protrude horizontally. Here, the supporter 736 may not necessarily be formed in a circular shape, but may be formed in various shapes including the triangular shape and the quadrangular shape, like the tray support part 711 of the base 71. The mixing shaft 737 is seated in the mixing shaft seating groove 712 formed at the tray support part 711.

Also, a connection end 735 is formed to protrude from the rear end of the tray 73. The connection end 735 is a part which is connected with the driving unit 74.

Meanwhile, the driving unit 74 includes a mixing motor 741 which generates a driving force, a first link 743 of which one end is connected to a motor shaft 742 of the mixing motor 741, and a second link 744 of which one end is connected to the other end of the first link 743 through a connection shaft 745. The other end of the second link 744 is connected to the connection end 735, and thus a three-bar link structure is formed.

Due to such a structure, when the mixing motor 741 is driven, the motor shaft 742 is rotated, and the other end of the first link 743 is rotated about the motor shaft 742 according to rotation of the motor shaft. The other end of the second link 744 is shaken up and down according to rotation of the first link 743. As a result, the tray 73 performs the swing motion about the mixing shaft 737 within a predetermined angular range.

Figure 20:
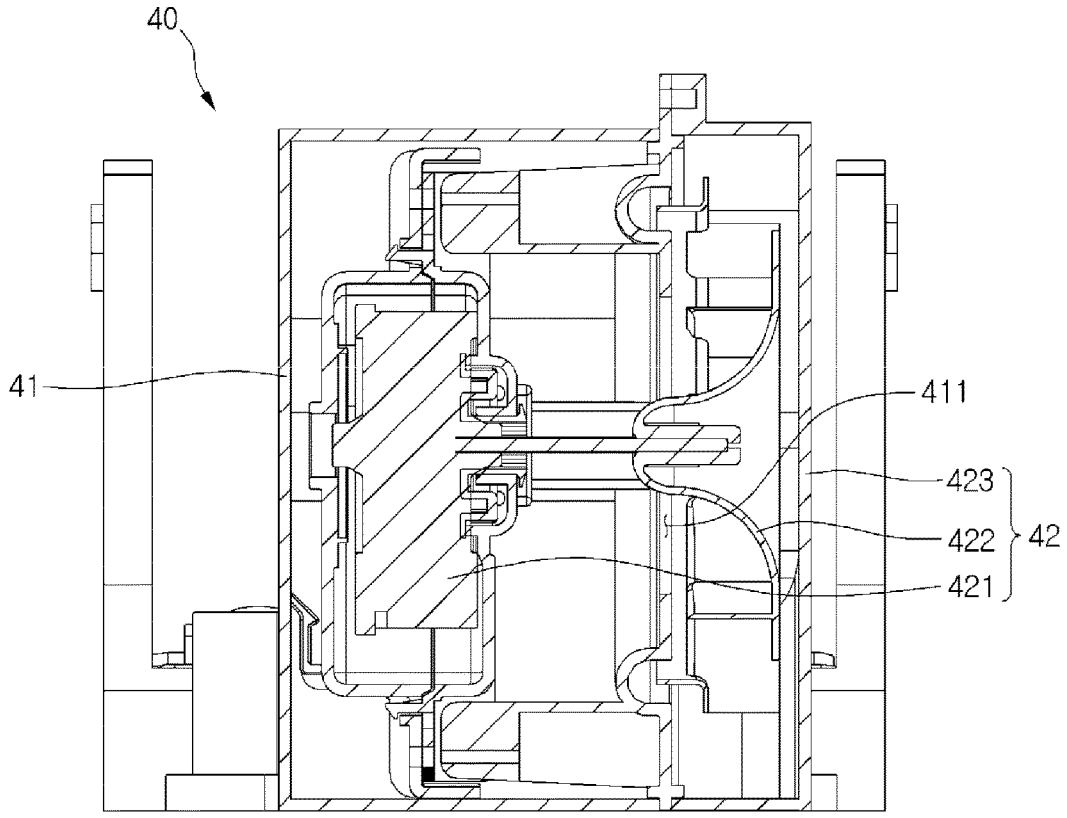
FIG. 20 is a cross-sectional view taken along IV-IV' of FIG. 18.

FIG. 20 is a cross-sectional view taken along IV-IV' of FIG. 18.

Referring to FIG. 20, the cool air supply unit 40 of the cooling device 60 according to the third embodiment of the present invention includes a suction duct 41 of which a suction end is connected to an evaporator compartment, a fan housing 423 which is connected to one side of the suction duct 41, a cooling fan 422 which is installed inside the fan housing 423, and a fan motor 421 which rotates the cooling fan 422. The fan motor 421 may be accommodated inside the suction duct, and the cooling fan 422 may be a centrifugal fan which axially suctions the cool air and then radially discharges the cool air. A discharge end of the fan housing 423 is in communication with a suction end of the discharge duct 43.

More specifically, the other end of the suction duct 41 may be blocked, and the fan motor 421 may be installed inside the suction duct 41 corresponding to the other end thereof. A communication hole 411 is formed at a side surface of the suction duct 41, and the fan housing 423 is installed outside the communication hole 411. Therefore, the cool air suctioned through the suction duct 41 passes through the communication hole 411, and a flow thereof is switched in a radial direction of the cooling fan 422, and guided to an entrance end of the discharge duct 43. The cool air flowing through the discharge duct 43 is moved to the cool air chamber of the base 71, and then injected to the beverage container through the discharge ports 721 protruding from the discharge grille 72.

Characteristics of the cooling device according to the third embodiment are as follows.

The cooling device according to the third embodiment of the present invention includes a base in which cool air discharge ports are formed at an upper surface thereof; a tray located above the base, having a container support part on which a beverage container is placed, and configured to perform a swing motion by a predetermined angle while connected with the base; a driving unit configured to enable the tray to perform the swing motion; and a cool air supply unit connected to one side of the base and configured to guide low temperature cool air toward the base, and the base may include a cool air chamber in which the cool air supplied from the cool air supply unit is gathered, a discharge grille which covers an upper surface of the cool air chamber and has a plurality of cool air discharge ports, and a tray support part which extends upward from both side surfaces thereof and rotatably supports the tray, and the tray may include a cool air guide hole through which the cool air passes, a first container support part in which a beverage container is transversely placed, and one pair of second container support parts in which two beverage containers are disposed in parallel with each other in a forward and backward direction.

The storage compartment may be a freezer compartment.

The tray may further include a support rib which protrudes from each of the first and second container support parts.

The tray may further include a partition rib which divides the pair of container support parts, and the partition rib may extend from an edge of the tray toward a center thereof.

The upper surface of the base may be formed to be inclined, such that a front end thereof is located lower than a rear end thereof.

Each of the cool air discharge ports may be formed in a boss or nozzle shape which protrudes from the discharge grille.

The air supply unit may include a suction duct of which an entrance end is connected to an evaporator compartment of the refrigerator, a fan housing which is connected to a discharge end of the suction duct, a cooling fan which is accommodated in the fan housing, a fan motor which is accommodated inside the suction duct to drive the cooling fan, and a discharge duct of which an entrance end is connected to a discharge end of the fan housing, and a discharge end is connected to an entrance end of the cool air chamber.

The driving unit may include a mixing motor, a first link of which one end is connected to a shaft of the mixing motor, a second link of which one end is connected to the other end of the first link, and a connection end which extends from a rear end of the tray and is connected to the other end of the second link.

The tray may further include a supporter which extends upward from edges of both side surfaces thereof, and a mixing shaft which transversely protrudes from an outer surface of an upper end of the supporter, and a seating groove in which the mixing shaft is seated may be formed at an upper end of the tray support part.

The invention claimed is:

1. A cooling device comprising:

a case;

a tray installed inside the case and on which a beverage container is placed;

a mixing member configured to cause the tray to perform a seesaw motion about a mixing axis to mix a fluid in the beverage container; and a cool air supply configured to provide cool air into the case, wherein the mixing member comprises:

a supporter configured to protrude from a bottom of the case, the tray being connected to an upper end of the supporter to perform the seesaw motion around the upper end of the supporter;

a driving link connected to one end of the case; and a mixing motor configured to transmit a driving force to the driving link, and wherein the tray comprises:

a tray body;

a first seating surface formed on the tray body and configured to position the beverage container, when received in the first seating surface, in a first direction of the tray body; and a plurality of second seating surfaces formed on the tray body and configured to position the beverage container, when received in one of the second seating surfaces, in a second direction that is perpendicular to the first direction, wherein the first seating surfaces and the second seating surfaces are roundly formed to surround a portion of an outer surface of the beverage container, and wherein the plurality of second seating surfaces are provided in the first direction and in parallel to each other.

2. The cooling device of claim 1, wherein cool air passing holes are respectively formed at inner portions of the first seating surface and the second seating surfaces.

3. The cooling device of claim 2, wherein the tray further comprises a support rib protruding from an edge of each of the first seating surface and the second seating surfaces, to prevent a movement of the beverage container from the tray during the seesaw motion of the tray.

4. The cooling device of claim 3, further comprising a cam which connects a rotational shaft of the mixing motor with one end of the driving link, wherein the one end of the driving link is connected to a portion of the cam which is biased from a rotational center of the cam towards an edge of the cam.

5. The cooling device of claim 3, wherein the tray is installed to be inclined upward towards a rear end of the tray.

6. The cooling device of claim 3, further comprising a cover rotatably installed at a front surface of the case, wherein at least one of an upper surface or a rear surface of the case is opened.

7. The cooling device of claim 3, wherein the case is installed at a freezer compartment of a refrigerator, and an evaporator compartment is formed behind the freezer compartment, and the cool air supply is in communication with the evaporator compartment, and wherein an upper portion of the case is opened such that the tray is exposed to cold air in the freezer compartment.

8. The cooling device of claim 7, wherein the cool air supply comprises:

a suction duct which is in communication with the evaporator compartment;

a fan housing which is connected to the suction duct; and a discharge duct which extends from the fan housing to a lower side of the tray.

9. The cooling device of claim 8, further comprising a discharge grille installed at a discharge end of the discharge duct and having a plurality of air holes.

10. The cooling device of claim 1, further comprising;

a cover provided at a front surface of the case;

a cooling fan configured to generate a flow of the cool air inside the case; and a controller configured to control driving of at least one of the mixing motor and the cooling fan, wherein the controller, when controlling the driving of the at least one of the mixing motor and the cooling fan is further configured to:

detect opening and closing of the cover;

drive the mixing motor for a predetermined time when the closing of the cover is detected, stop the mixing motor after the predetermined time, and calculate a load applied to the mixing motor when driving the motor during the predetermined time;

calculating calculate a weight of a beverage according to the load;

calculate a cooling time according to the calculated weight; and drive the cooling fan during the calculated cooling time.

11. The cooling device of claim 10, wherein data associating different weights of the beverage with different loads is stored by the controller in the form of a look-up table.

12. The cooling device of claim 11, wherein data associating different cooling times with the different calculated weights of the beverage is further stored in the controller in the form of the look-up table.

13. The cooling device of claim 12, wherein the controller is further configured to operate a timer when the cooling fan is driven.

14. The cooling device of claim 13, wherein the controller is further configured to detect in real time whether a door of a storage compartment in which the cooling device is accommodated or the cover is opened, while the cooling fan is driven.

15. The cooling device of claim 14, wherein the controller is further configured to, when the opening of the door of the storage compartment or the cover is detected while the cooling fan is driven, temporarily stop the cooling fan and the timer.

16. The cooling device of claim 15, wherein the controller is further configured to, when the closing of the door of the storage compartment or the cover is detected:

reactivate the temporarily stopped cooling fan and timer, and when an operational time of the reactivated cooling fan and timer reaches the calculated cooling time, stop the cooling fan, and reset the timer.

17. The cooling device of claim 10, wherein the controller is further configured to, when the cooling time is calculated, automatically start an operation of the mixing motor.

18. The cooling device of claim 10, wherein the controller is further configured to, when the cooling time is calculated and a command for starting a cooling operation is input, start an operation of the mixing motor.

19. The cooling device of claim 18, wherein the controller is further configured to, when the command for starting the cooling operation is not input during a predetermined period of time the cooling time is calculated, terminate the cooling operation.

* * * * *